US006055750A

United States Patent [19]

Yoder et al.

[11] Patent Number: 6,055,750

[45] Date of Patent: May 2, 2000

[54] EXCAVATING MACHINE WITH LIFT ARM ASSEMBLY

[75] Inventors: Shaun Lamar Yoder; Steven J. Ditzler, both of Wellman, Iowa

[73] Assignee: Samson Enterprises, Inc., Wellman, Iowa

[21] Appl. No.: 08/782,622

[22] Filed: Jan. 13, 1997

[51] Int. Cl.[7] ..... E02F 5/08; E02F 5/14

[52] U.S. Cl. ..... 37/352; 37/91

[58] Field of Search ..... 37/91, 92, 93, 37/94, 95, 96, 97, 443, 352, 367; 299/39.6, 76

[56] References Cited

U.S. PATENT DOCUMENTS

| | | | |
|---|---|---|---|
| 3,332,249 | 7/1967 | Idoine | 37/95 X |
| 3,510,970 | 5/1970 | Mikhailov | 37/94 |
| 3,540,139 | 11/1970 | Gethmann et al. . | |
| 3,610,691 | 10/1971 | Pemote et al. . | |
| 3,680,919 | 8/1972 | Rear et al. . | |
| 3,967,854 | 7/1976 | Posciri . | |
| 3,994,083 | 11/1976 | Cunningham . | |
| 4,110,920 | 9/1978 | Brown . | |
| 4,152,850 | 5/1979 | Alshits et al. | 37/97 |
| 4,179,829 | 12/1979 | Kinkade . | |
| 4,768,297 | 9/1988 | Rivard . | |
| 4,785,560 | 11/1988 | Hanson | 37/96 X |
| 4,976,051 | 12/1990 | Kovalev et al. . | |
| 5,007,882 | 4/1991 | Mizumoto et al. | 37/443 |
| 5,144,760 | 9/1992 | McGuire . | |
| 5,203,101 | 4/1993 | Bryan . | |
| 5,333,399 | 8/1994 | Mett . | |
| 5,375,347 | 12/1994 | Fleischhaker . | |
| 5,381,616 | 1/1995 | Disney . | |
| 5,404,660 | 4/1995 | Webster | 37/189 |

FOREIGN PATENT DOCUMENTS

| | | | |
|---|---|---|---|
| 1049790 | 1/1959 | Germany | 37/91 |
| 1113483 | 9/1984 | U.S.S.R. | 37/91 |
| 1559060 | 4/1990 | U.S.S.R. | 37/91 |

OTHER PUBLICATIONS

Undated brochure entitled "All Hydrostatic Buckeye 7200" of H & S Co., Inc.

Undated brochure entitled "Trenchless Plows Dynapac–Hoes 623/624/784" of Dynapac–Hoes GmbH.

Undated brochure entitled "Drainage Machine Hoes Gigant 1800" of Dynapac Hoes Trencher Division.

Undated brochure entitled "Trencher Dynapac–Hoes 3000" of Dynapac–Hoes GmbH.

Undated brochure entitled "Drainage Machine Hoes Gigant 3000" of Dynapac Hoes Trencher Division.

Undated brochure entitled "High Productivity Trencher & Plows" of Dynapac–Hoes GmbH.

Undated brochure entitled "Eagle 4500 Wheel Trencher" of Eagle Trencher Corporation.

Undated brochure entitled "Port Industries, Inc. Hydramaxx 2400" of Port Industries, Inc.

Undated brochure entitled TESMEC USA, Inc. TRS–1175–D6/TRS–1175–D7 Chainsaw and Rocksaw Specifications of Tesmec, USA, Inc.

Undated brochure entitled "RWF BRON Self–Propelled Trenchers and Plows" of RWF Bron.

(List continued on next page.)

*Primary Examiner*—Eileen Dunn Lillis
*Assistant Examiner*—Gary S. Hartmann
*Attorney, Agent, or Firm*—Brian J. Laurenzo; Michael C. Gilchrist

[57] ABSTRACT

An excavating machine is provided having an L-arm assembly located between a power unit and an earth cutting device, the L-arm assembly for raising and lowering the earth cutting device. The L-arm assembly has a first arm for operable attachment to the power unit and a second arm integral with and substantially transverse to the first arm for operable attachment to the earth cutting device. The first arm of the L-arm assembly is longer than the second arm of the L-arm assembly. Hydraulic cylinders are included resulting in an earth cutting device which is held down into the ground in a positive manner so as to be more efficient in operation.

22 Claims, 20 Drawing Sheets

OTHER PUBLICATIONS

Undated brochure entitled "Samson 3700RS" of Samson Enterprises, Inc.

August, 1994 brochure entitled "T–455" of Vermeer Manufacturing Company.

1994 brochure entitled "T–755 Hydrostatic Trencher with T.E.C. 2000" of Vermeer Manufacturing, Inc.

1995 brochure entitled "V–8550 Hydrostatic Trencher/Plow" of Vermeer Manufacturing Company.

1995 brochure entitled "T–655DT Hydrostatic Trencher with T.E.C. 2000" of Vermeer Manufacturing Company.

Sep., 1991 brochure entitled "T–655" of Vermeer Manufacturing Company.

1994 brochure entitled "In Five Hours He'll Go From Gumbo To Limestone to Caliche. And Do Nothing About It. Introducing T.E.C. 2000" of Vermeer Manufacturing Company.

EXCAVATING MACHINE WITH LIFT ARM ASSEMBLY

BACKGROUND OF THE INVENTION

The invention relates generally to excavating machines of the type having a device for cutting the earth including, but not limited to, bucket wheel trenchers, chain bar trenchers, trencher or trenchless plows and hoes, vibratory plows, disc wheel cutters, drum cutters, etc., and more particularly to a lift arm assembly for raising and lowering the earth cutting device and for providing downward pressure on the earth cutting device during use.

Excavating machines are well known for use in the cutting of an open trench having either vertical or sloped walls for the purposes of land drainage and irrigation including agricultural tiling, as well as the installation of utilities such as cable lines, pipelines, water lines, sewer lines, etc. These excavating machines are often of a vehicular type being self-contained and suitably driven for either over-the-road travel or movement during use of the earth cutting device.

Typically, the excavating machines of the prior art have used a set of slides or beams to raise and lower the earth cutting device, however, these machines rely on gravity to hold the earth cutting device down during use. There just isn't enough weight on the earth cutting device. These machines generally operate with difficulty due to the tendency of the earth cutting device to ride on, rather than penetrate into, the surface being worked on. This riding tendency results in appreciable bouncing of the machine and instability in its operation. In addition, this riding tendency results in a less than desirable rate of speed. Higher horsepowers are wasted if the earth cutting device is not effectively penetrating the surface being worked on. Efficiency is extremely important to the operators of these machines as inefficient operation costs time and, in turn, money.

The difficulties encountered in the prior art discussed hereinabove are substantially eliminated by the present invention.

SUMMARY OF THE INVENTION

Accordingly, it is an object of the present invention to provide an excavating machine having improved means for raising and lowering the earth cutting device.

An additional object of the present invention is to provide an excavating machine with means for raising and lowering the earth cutting device which is connected directly to the earth cutting device.

It is another object of the present invention to provide an excavating machine having means for providing downward pressure on the earth cutting device during use.

It is still another object of the present invention to provide an excavating machine with improved weight distribution between the power unit and the earth cutting device.

It is a further object of the present invention to provide an excavating machine which can be operated more efficiently.

An additional object of the present invention is to provide an excavating machine which can operate under more horsepower to do more work.

A further object of the present invention is to provide an excavating machine which can dig a non-vertical trench or a vertical trench in uneven ground.

Other features and advantages of the present invention will become apparent upon a review of the following description, drawings and claims.

By the present invention, it is proposed to overcome the difficulties encountered heretofore. To this end, an excavating machine is provided having improved means for raising and lowering the earth cutting device, the excavating machine having a power unit; earth cutting means; and an L-arm assembly located between the power unit and the earth cutting means, the L-arm assembly having a first arm for operable attachment to the power unit, the first arm having a first end and a second end opposite to the first end, the L-arm assembly further having a second arm integral with and substantially transverse to the first arm for operable attachment to the earth cutting means, the second arm having a first end integral with the first end of the first arm and a second end opposite to the first end of the second arm, the first arm of the L-arm assembly being longer than the second arm of the L-arm assembly. Means for raising and lowering the L-arm assembly and means for controlling the pitch of the earth cutting means relative to the L-arm assembly are also included.

In the preferred embodiment, means for adjusting the angle of the earth cutting device from vertical are included in order to allow for the digging of a non-vertical trench or for the digging of a vertical trench in uneven ground.

DETAILED DESCRIPTION OF THE INVENTION

Figure 1:
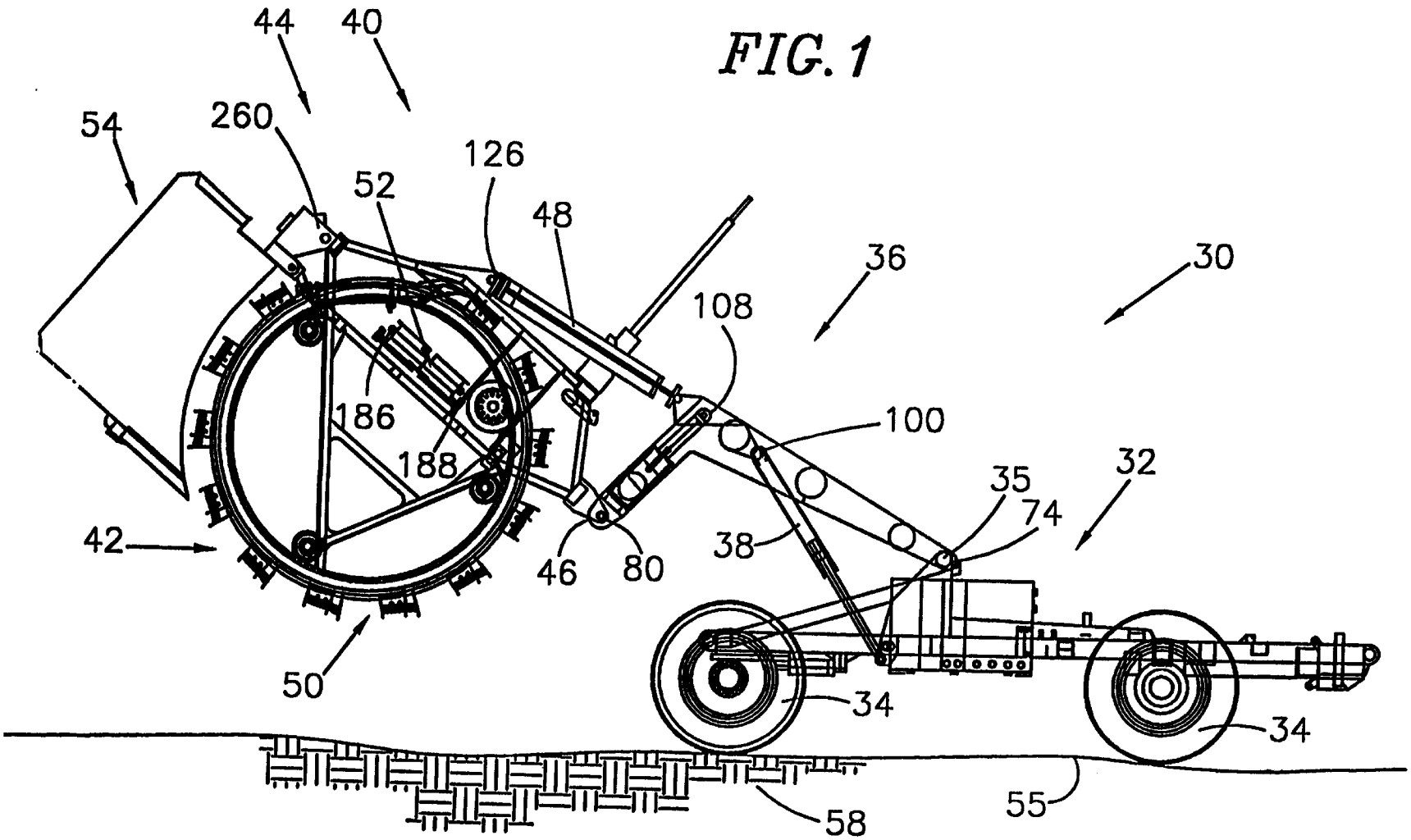
FIG. 1 is a front elevational view of an excavating machine with its earth cutting means in a raised position in accordance with the present invention.

Referring to FIG. 1, the numeral 30 generally designates the excavating machine of the present invention. The excavating machine 30 includes a power unit vehicle 32 supported by wheels 34. Pivotally mounted about a horizontal axis 35 on the power unit vehicle 32 is an L-arm assembly 36 which is adapted to be raised and lowered by means of a hydraulic cylinder 38. Pivotally mounted to the L-arm assembly 36 are earth cutting means 40. The earth cutting means 40 of the preferred embodiment comprise a bucket wheel trencher assembly 42 but, alternatively, could comprise a chain bar trencher, a trencher or trenchless plow or hoe, a vibratory plow, a disc wheel cutter, a drum cutter or any other earth cutting device. The earth cutting means 40 comprise a supporting frame assembly 44. The supporting frame assembly 44 is pivotally mounted about a horizontal axis 46 as part of a means for controlling the pitch of the earth cutting means 40, and this pivotal movement is controlled by a second hydraulic cylinder 48. Rotatably mounted to the supporting frame assembly 44 is a wheel assembly 50. Also mounted to the supporting frame assembly 44 are a conveyor assembly 52 and a shoe assembly 54.

Figure 2:
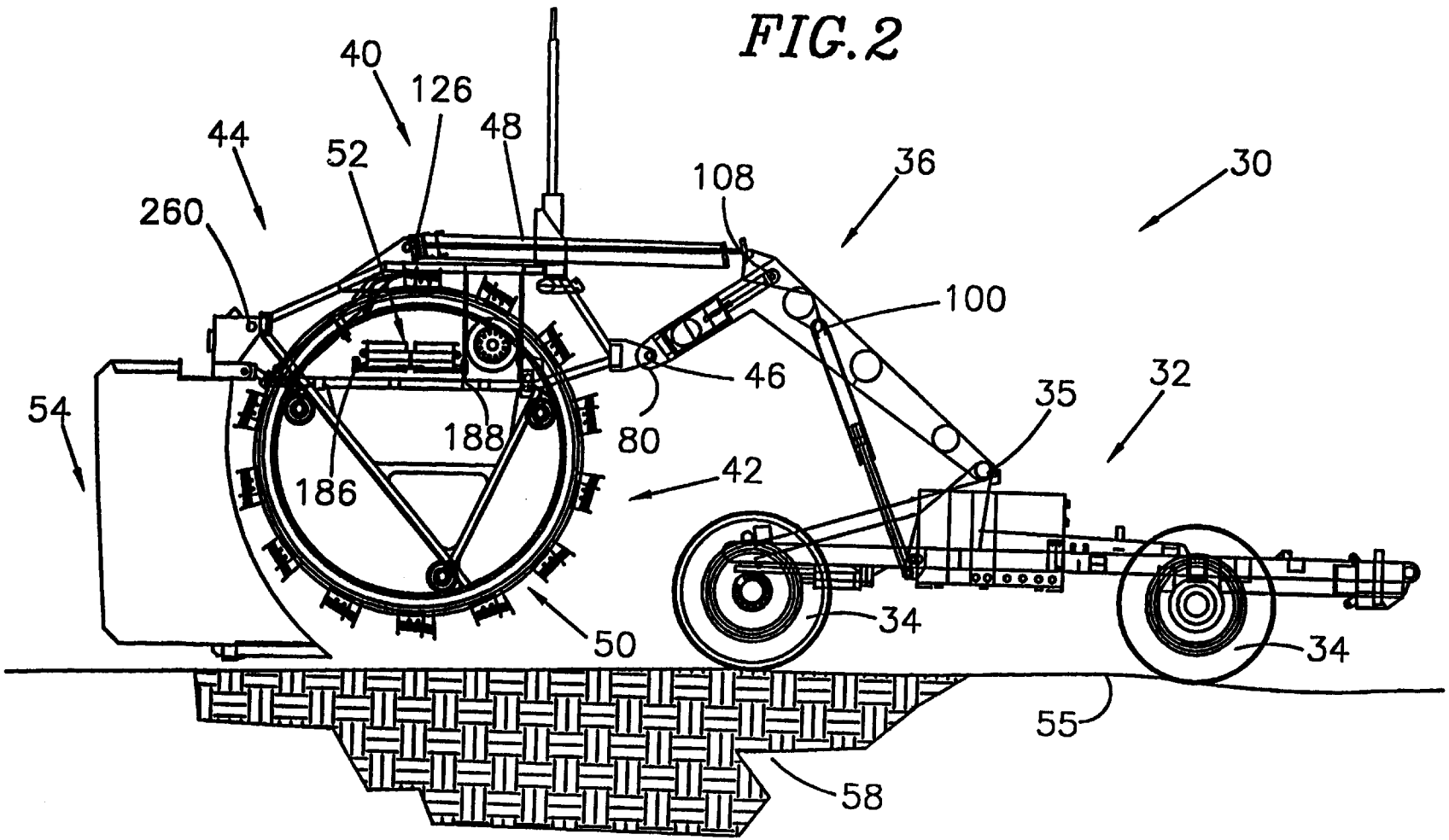
FIG. 2 is a front elevational view of the excavating machine shown in FIG. 1 with its earth cutting means at ground level.
Figure 3:
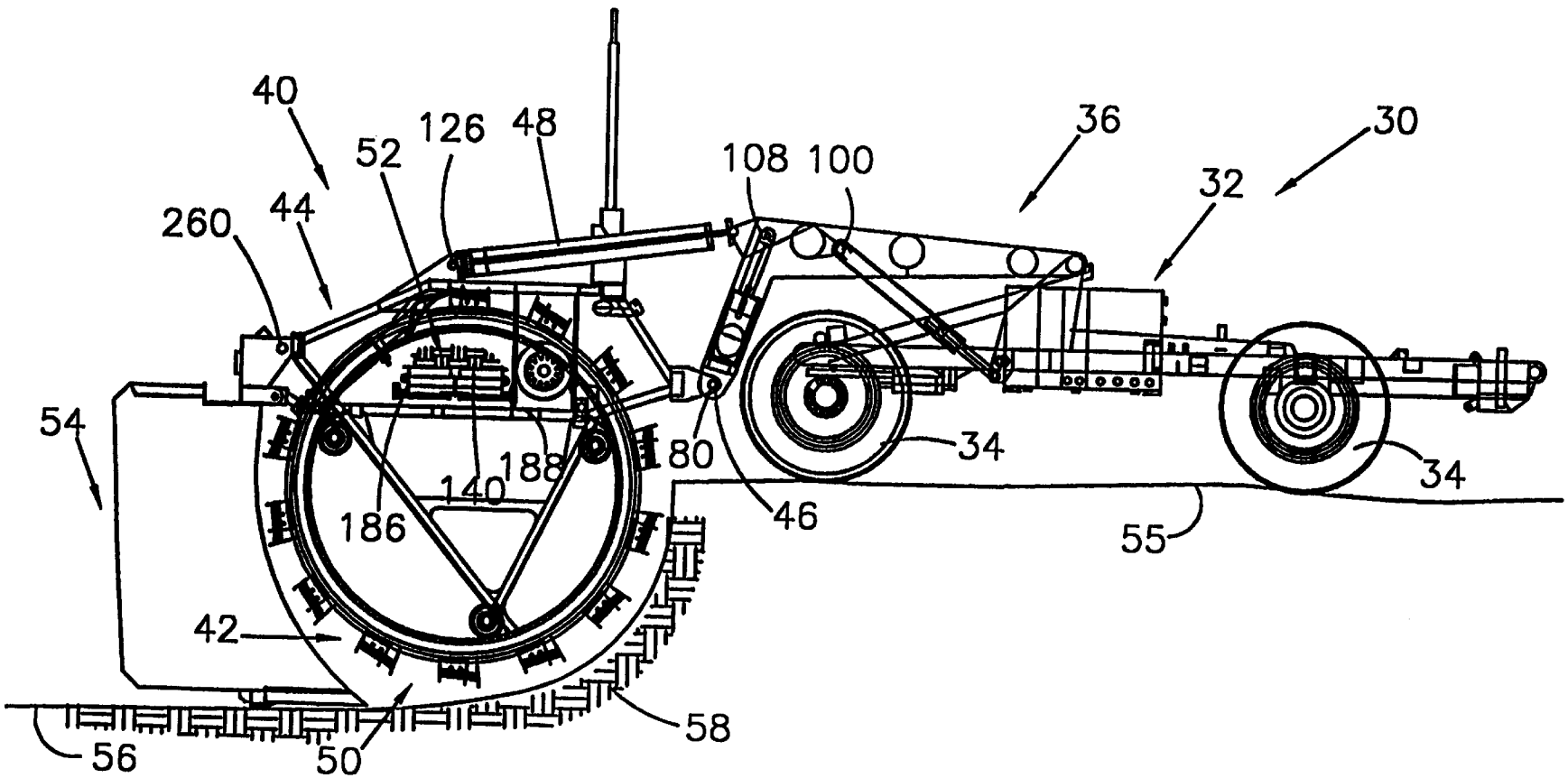
FIG. 3 is a front elevational view of the excavating machine shown in FIG. 1 with its earth cutting means partially below ground level.
Figure 4:
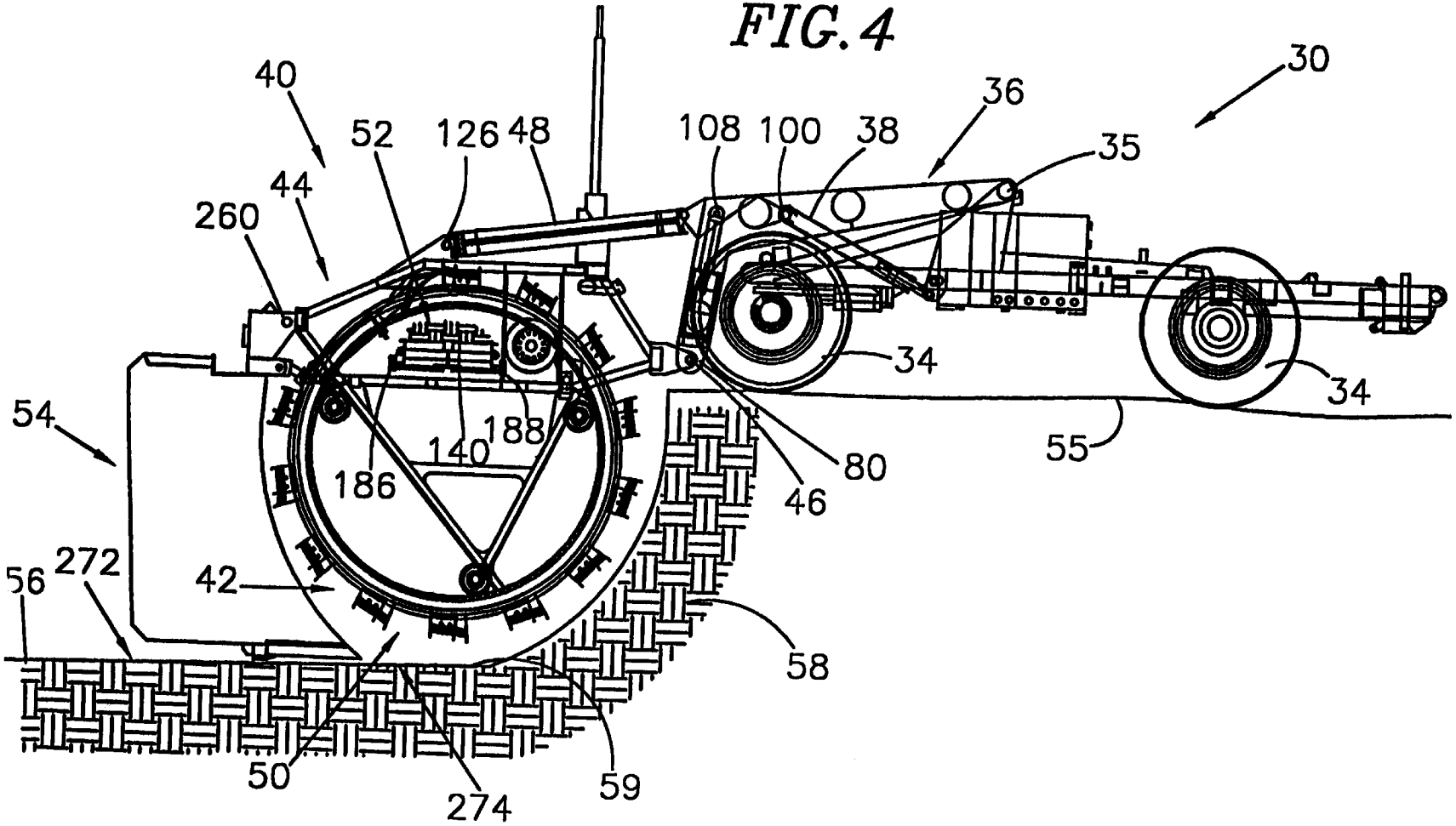
FIG. 4 is a front elevational view of the excavating machine shown in FIG. 1 with its earth cutting means at the bottom of a trench.

FIGS. 1–4 schematically show the excavating machine 30 in its range of positions. FIG. 1 shows the earth cutting means 40 in a fully raised position. FIG. 2 shows the earth cutting means 40 lowered to ground level 55. FIG. 3 shows the earth cutting means 40 partially below ground level 55 as a trench 56 in the ground 58 is begun. FIG. 4 shows the earth cutting means 40 in a position at the bottom 59 of the trench 56 in the ground 58.

FIGS. 5–8 show the improved means for raising and lowering the earth cutting means 40 which comprise the L-arm assembly 36. The L-arm assembly 36 is located between the power unit vehicle 32 and the earth cutting means 40. The L-arm assembly 36 includes a first arm 60 having a first end 62 and a second end 64 opposite to the first end 62. The L-arm assembly 36 further includes a second arm 66 integral with and substantially transverse to the first arm 60. The second arm 66 has a first end 68 integral with the first end 62 of the first arm 60 and a second end 70 opposite to the first end 68 of the second arm 66. The second end 64 of the first arm 60 includes apertures 72 for receiving a pivot member 74 for pivotal attachment to the power unit vehicle 32. The second end 70 of the second arm 66 includes an extended lift member 76 having an apertures 78 for receiving a pivot member 80 for pivotal attachment to the supporting frame assembly 44 about horizontal axis 46. The first arm 60 of the L-arm assembly 36 is longer than the second arm 66 of the L-arm assembly 36.

Figure 5:
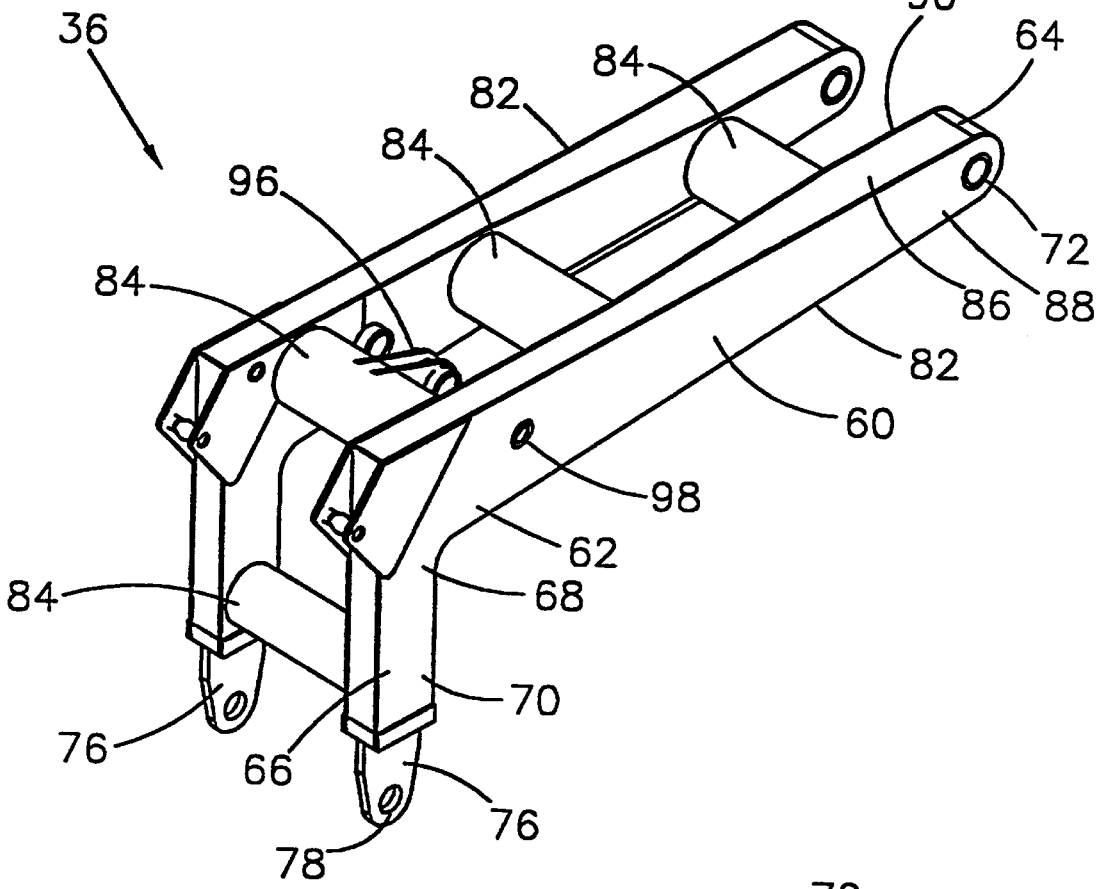
FIG. 5 is a top perspective view of an L-arm assembly in accordance with the present invention.
Figure 6:
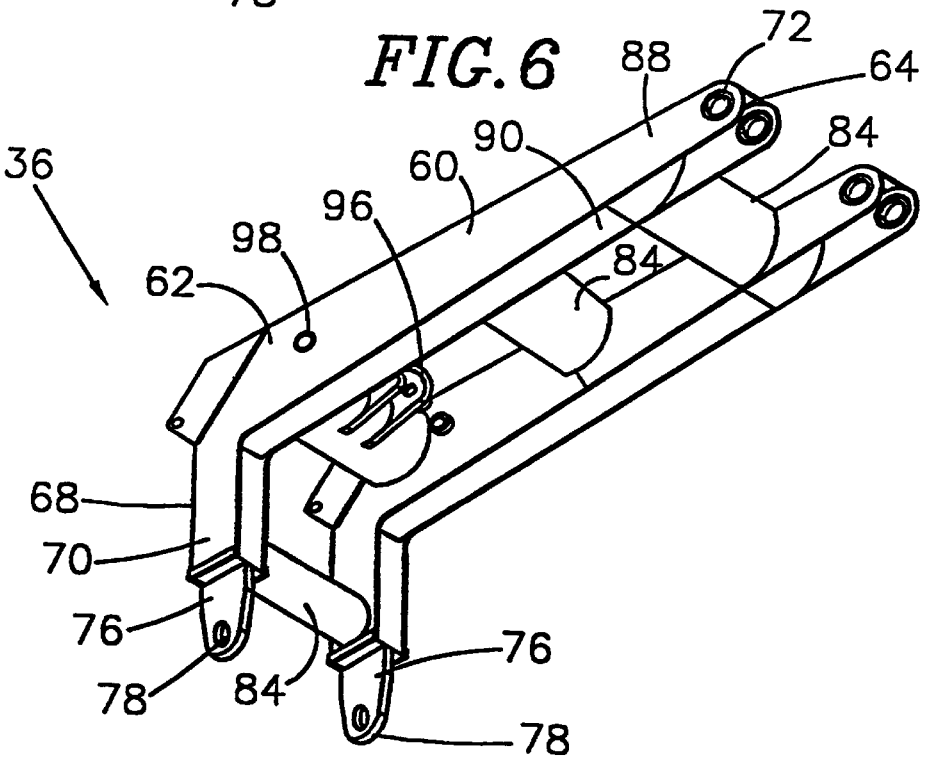
FIG. 6 is a bottom perspective view of the L-arm assembly shown in FIG. 5.

While it is anticipated that the L-arm assembly 36 could comprise one L-arm of solid construction (not shown), the preferred embodiment as shown in FIGS. 5 and 6 show an assembly of two separate L-arms 82 spaced apart by tubular support members 84. In addition, FIGS. 5 and 6 show that the first arm 60 of each L-arm 82 is comprised of a top plate 86 and first and second side plates 88 and 90, respectively, the first side plate 88 being substantially parallel with the second side plate 90 with a slight divergence between the first side plate 88 and second side plate 90 from the first end 62 of the first arm 60 to the second end 64 of the first arm 60. In addition, the second arm 66 of each L-arm 82 is comprised of a rectangular housing 94 with the extended lift members 76 extended from the second end 70 thereof.

The L-arm assembly 36 also includes means for attachment to the hydraulic cylinder 38 to raise and lower the L-arm assembly 36 in the form of two gusset plates 96 having apertures 98 therein for receiving a pivot member 100 for pivotal attachment to the hydraulic cylinder 38. It is preferred that these means for attachment to the hydraulic cylinder 38 be proximate to the first end 62 of the first arm 60 of the L-arm assembly 36.

Figure 7:
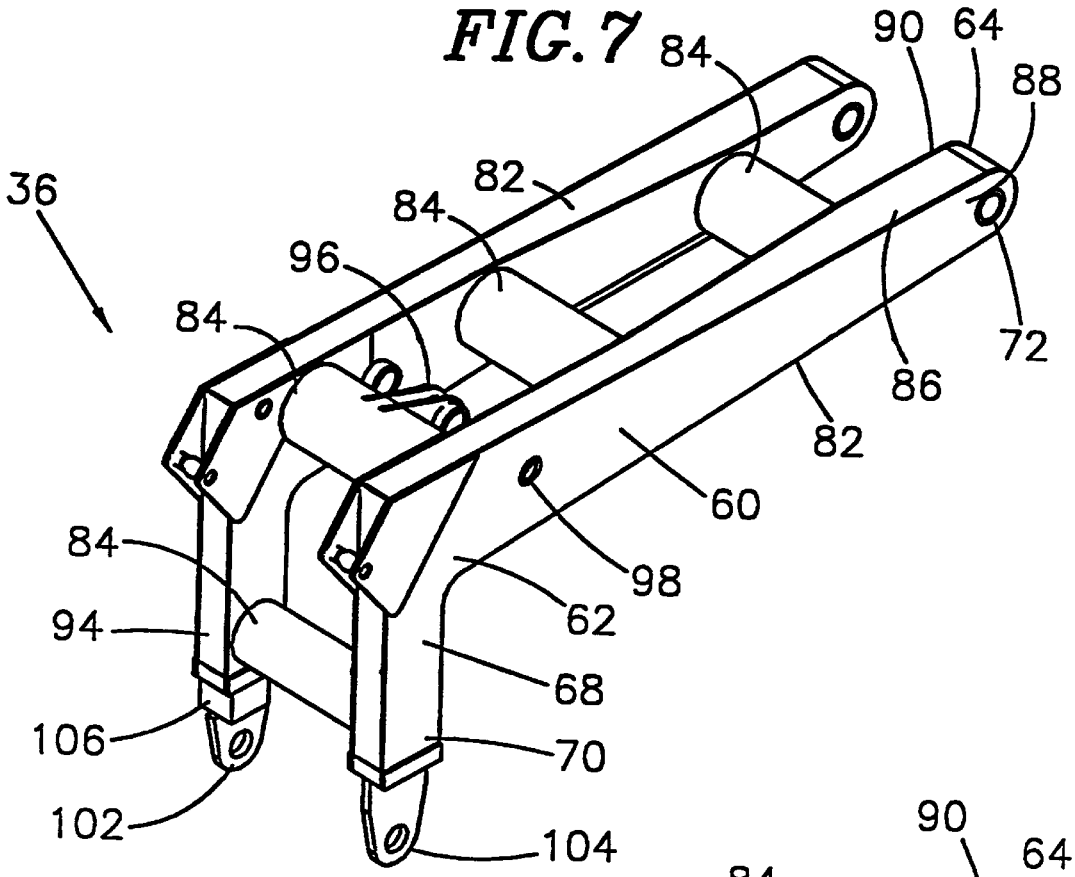
FIG. 7 is a top perspective view of the L-arm assembly showing a slidable leg member in its extended position.
Figure 8:
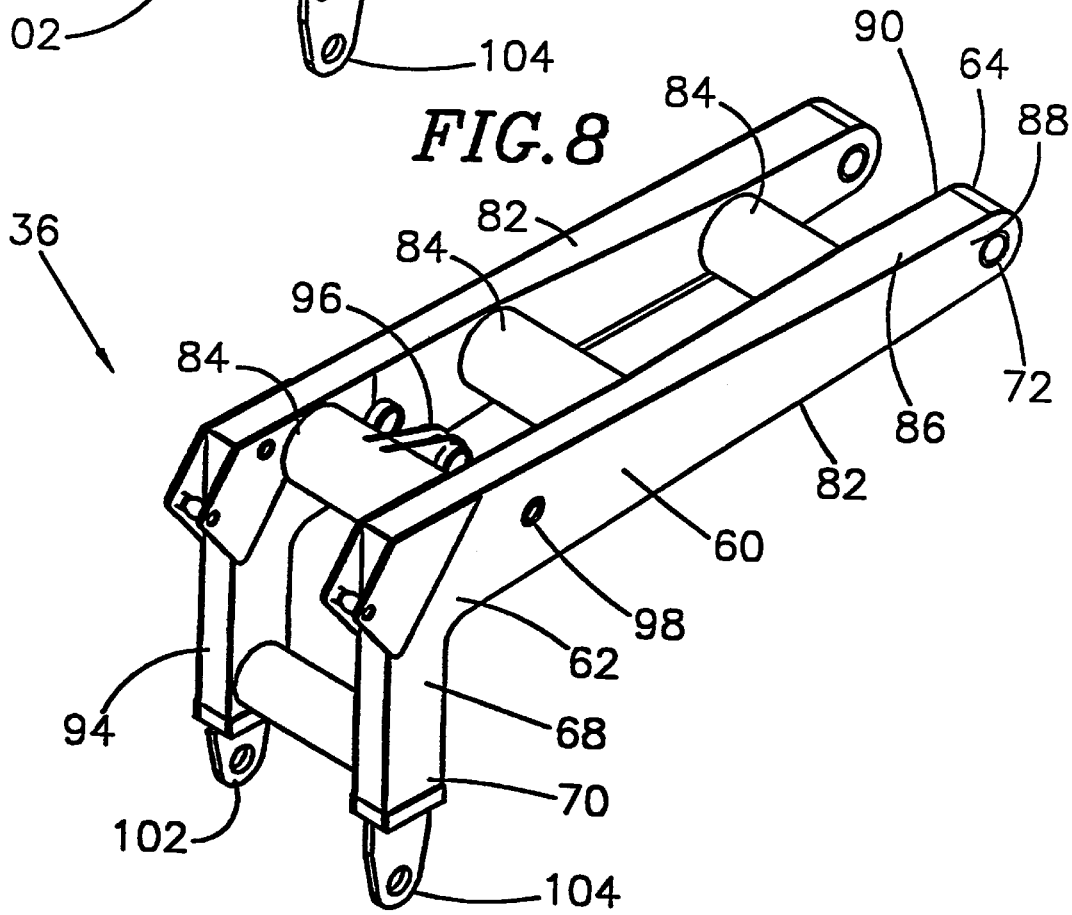
FIG. 8 is a top perspective view of the L-arm assembly shown in FIG. 7 showing the slidable leg member in its retracted position.

In the preferred embodiment wherein the L-arm assembly 36 is made up of two parallel L-arms 82, one of the parallel second arms 66 includes within its rectangular housing 94 means for extending and retracting the extended lift member 76 means for extending and retracting an extended lift member 102 relative to a rigidly connected extended lift member 104 are shown in FIGS. 7 (extended) and 8 (retracted). A telescoping housing 106 is operably attached between a linear actuator 108 (shown uncovered in FIGS. 1–4) and the lift member 102. The L-arm assembly 36 also includes mounting flanges 110 having apertures 112 therein for operable attachment to the second hydraulic cylinder for controlling the pitch of the earth cutting means 40 through extension and retraction of same as shown in FIGS. 1–4.

While the L-arm assembly 36 of the present invention is shown on an excavating machine 30 having a bucket wheel trencher assembly 42, it is to be understood that this L-arm assembly 36 could be incorporated with any type of excavating machine having earth cutting means as original equipment or sold separately as a retrofit part for existing equipment.

Figure 9:
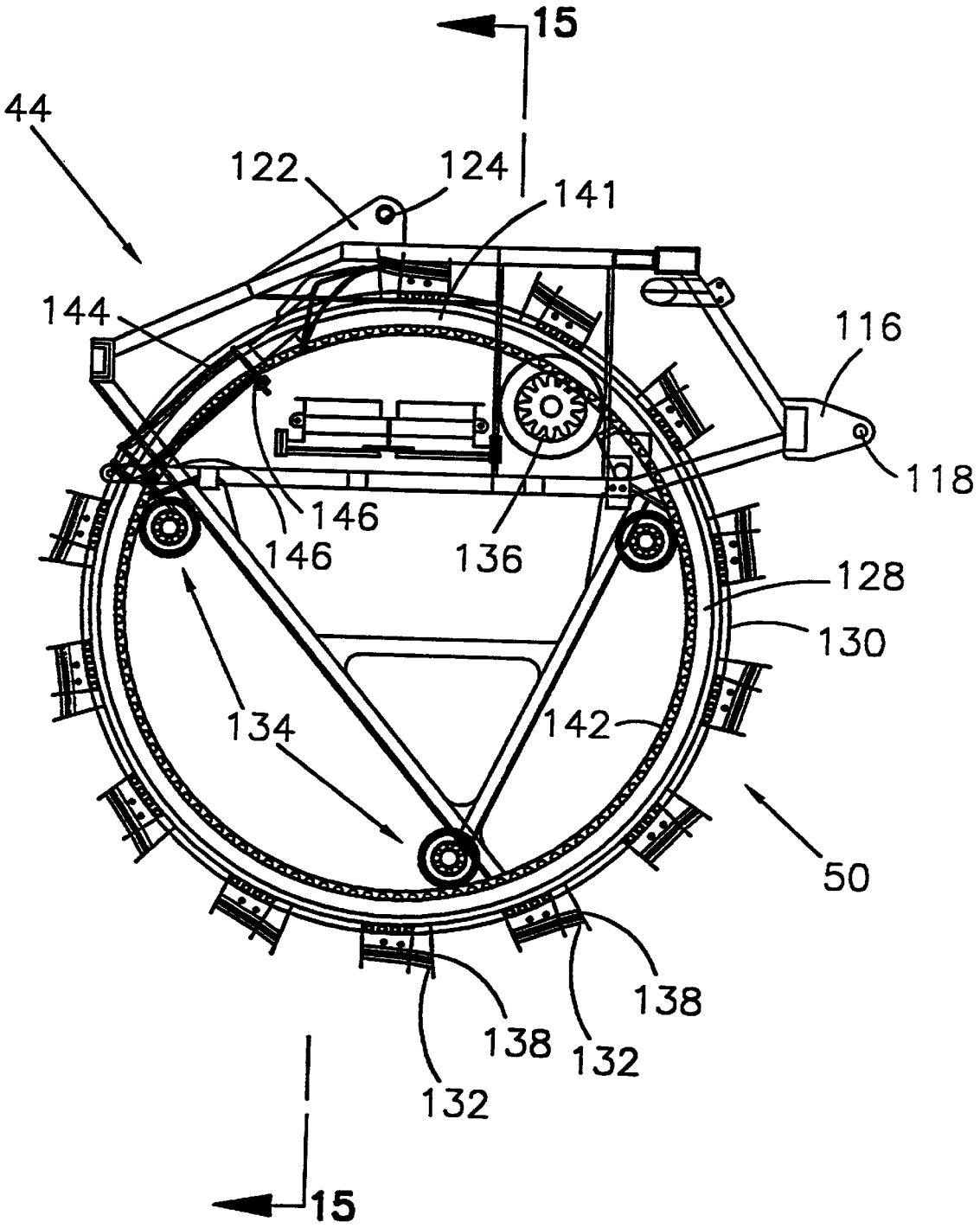
FIG. 9 is a front elevational view of the supporting frame assembly and the wheel assembly of the excavating machine shown in FIG. 1.
Figure 10:
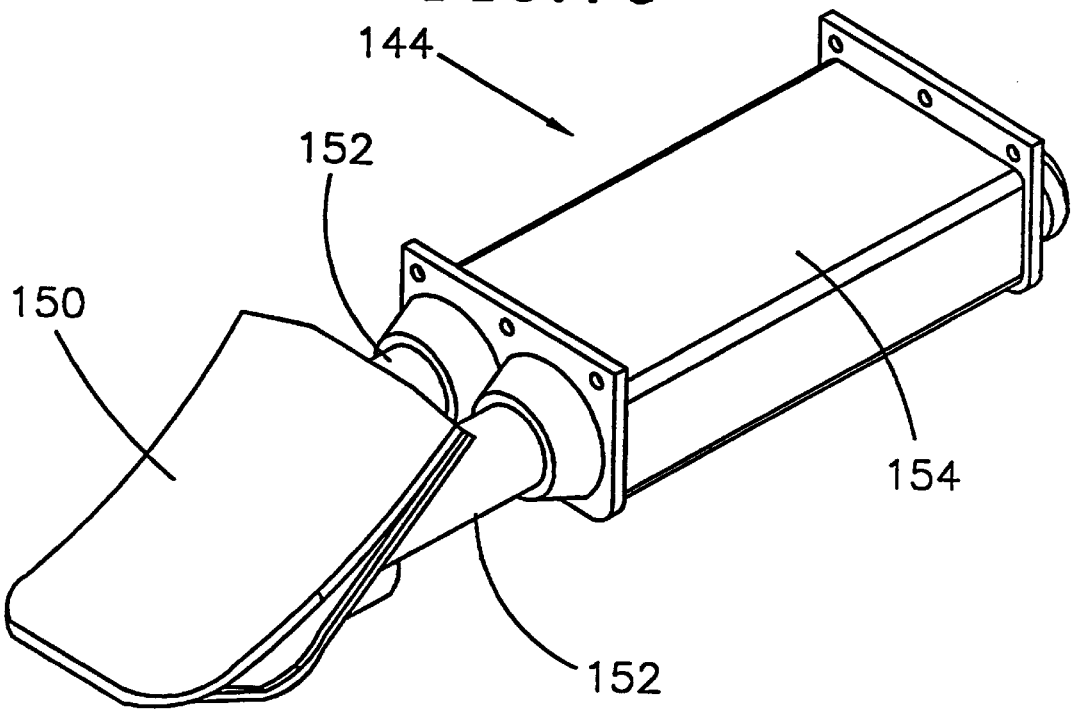
FIG. 10 is a bottom perspective view of a cleaning member in accordance with the present invention.
Figure 11:
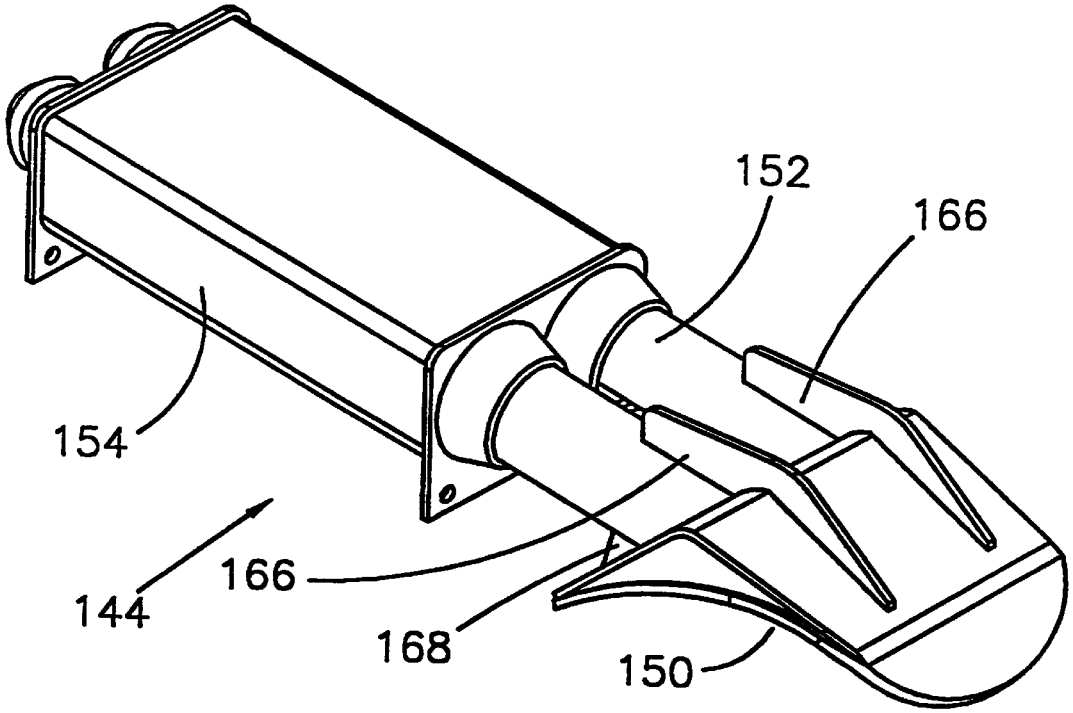
FIG. 11 is a top perspective view of the cleaning member shown in FIG. 10.
Figure 12:
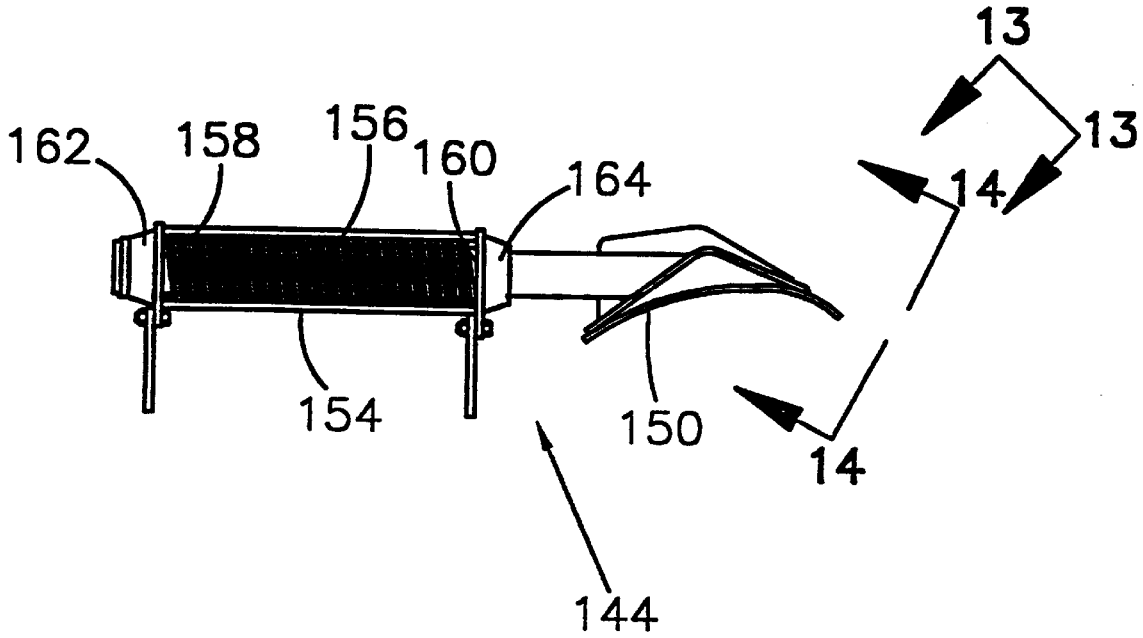
FIG. 12 is a front elevational view of the cleaning member shown in FIG. 10 partially in cross-section.
Figure 13:
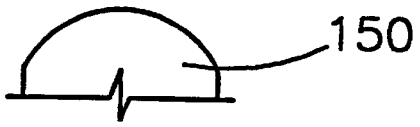
FIG. 13 is a view of the cleaning member shown in FIG. 12 taken along lines 13—13.
Figure 14:
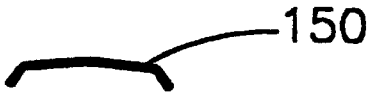
FIG. 14 is a sectional view of the cleaning member shown in FIG. 12 taken along lines 14—14.

FIG. 9 shows an enlarged elevational view of the supporting frame assembly 44 and the wheel assembly 50 mounted rotatably thereon. A hitch 116 having an aperture 118 therein is included for receiving pivot member 46 for pivotal attachment to the second end 70 of the second arm 66 of the L-arm assembly 36. In addition to pivotal movement upon extension or retraction of the hydraulic cylinder 48, when the slidable lift member 102 is extended or retracted relative to the fixed lift member 104 by linear actuator 108, the supporting frame assembly 44 and the wheel assembly 50 are adjustable from their normal vertical orientation. This is beneficial when a vertical trench is to be dug on uneven ground or when a non-vertical trench is to be dug.

The supporting frame assembly 44 also includes a flange 122 having an aperture 124 therein for receiving a fastening member 126 for operable attachment to the second hydraulic cylinder 48 for the supporting frame assembly 44. Accordingly, as the second hydraulic cylinder 48 for the wheel frame assembly 44 is extended and retracted, the pitch of the supporting frame assembly 44 is adjusted up or down in accordance therewith.

The wheel assembly 50 includes a digging wheel 128 having a rim structure 130 and a series of circumferentially spaced bucket members 132 peripherally extended from the rim structure 130 of the digging wheel 128. A truck roller assembly 134 is rigidly connected to the supporting frame assembly 44 for adjustment of the digging wheel 128 and to maintain the digging wheel 128 in a desired position. The digging wheel 128 is driven in a counter-clockwise direction by a drive mechanism 136. As the digging wheel 128 rotates, a leading edge 138 of the bucket member 132 excavates a portion of spoil 140 which is then carried by the bucket member 132 and the rim structure 130 to the top 141 of the digging wheel 128. An arc plate 142 keeps the spoil from passing through the rim structure 130 until it reaches the top 141 of the digging wheel 128 where it then falls onto the conveyor assembly 52 for expelling laterally to a spoil bank (not shown) on the side of the excavating machine 30.

Figure 15:
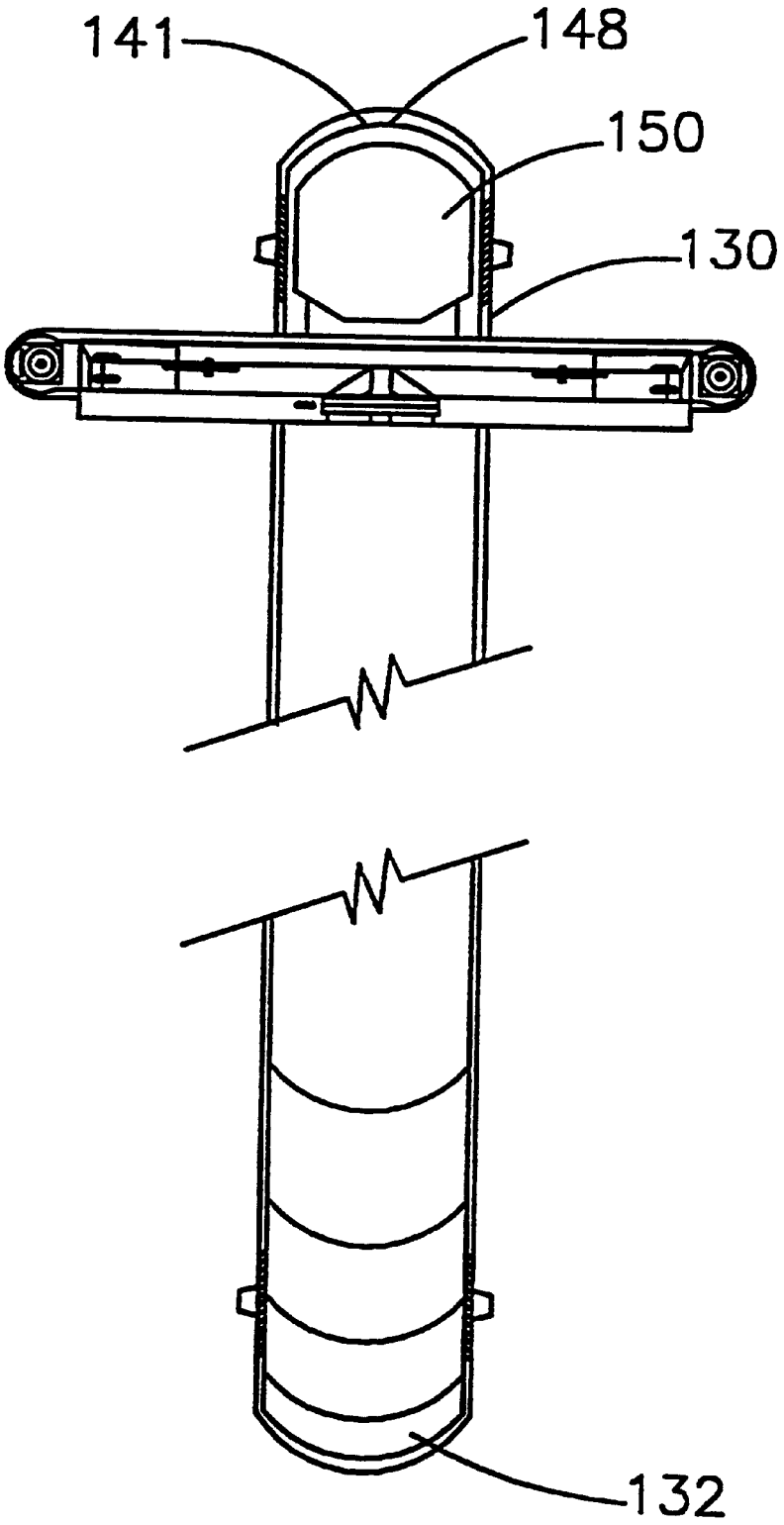
FIG. 15 is a partial cross-sectional elevational view of the wheel assembly shown in FIG. 9 taken along lines 15—15.

An improved cleaning member 144 is operably attached to the wheel frame assembly 44 at 146. The cleaning member 144 is shown in detail in FIGS. 10–14 and as positioned within an interior profile 148 of the rim structure 130 and the bucket member 132 of the digging wheel 128 in FIG. 15. The cleaning member 144 is positioned at an angle with a cleaning face 150 located at the top 141 of the digging wheel 128 in such a manner that it removes the spoil which has accumulated in the rim structure 130 and the bucket member 132 of the digging wheel 128 and directs the spoil 140 downwardly onto the conveyor assembly 52. The cleaning face 150 corresponds substantially in size and shape to the interior profile 148 of the rim structure 130 and the bucket member 132, the cleaning face 150 thereby fitting within the interior profile 148 of the rim structure 130 and the bucket member 132 to remove substantially all of the spoil 140 which has accumulated therein when the rim structure 130 and the bucket member 132 come into contact with the cleaning face 150.

The cleaning face 150 is arcuate in lateral cross-section (FIG. 14) and in longitudinal cross-section (FIG. 12) resulting in a concave shape in order to deflect the spoil 140 downward. Support gussets 166 and 168 are included to strengthen the cleaning face 150.

In the preferred embodiment, the cleaning face 150 is rigidly attached to a pair of support tube shafts 152 which pass through a housing 154 wherein coiled springs 156 are located between a mounting flange 158 and a washer 160. Bearing members 162 and 164 are located about the housing 154, which, along with the rest of the components of the cleaning member 144 allow the coil springs 156 to bias the cleaning face 150 into position within the interior profile 148 of the rim structure 130 and the bucket member 132 as well as to retract the cleaning face 150 upon contact with an obstruction (not shown) within the interior profile 148 of the rim structure 130 and the bucket member 132. This configuration allows for positive cleaning while preventing against damage upon contact with an obstruction.

Figure 16:
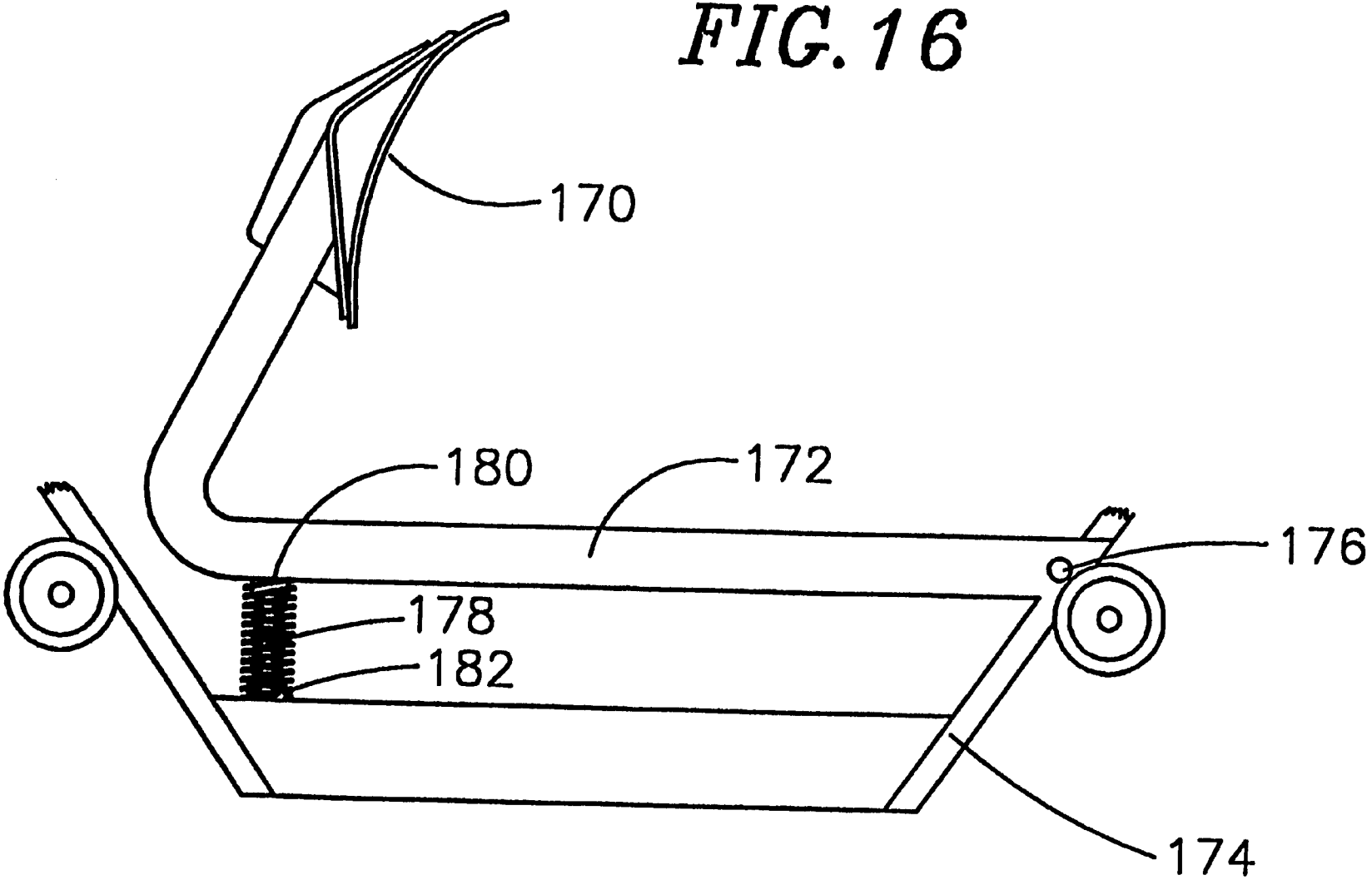
FIG. 16 is a front elevational view of an alternative cleaning member and wheel frame assembly in accordance with the present invention.
Figure 17:
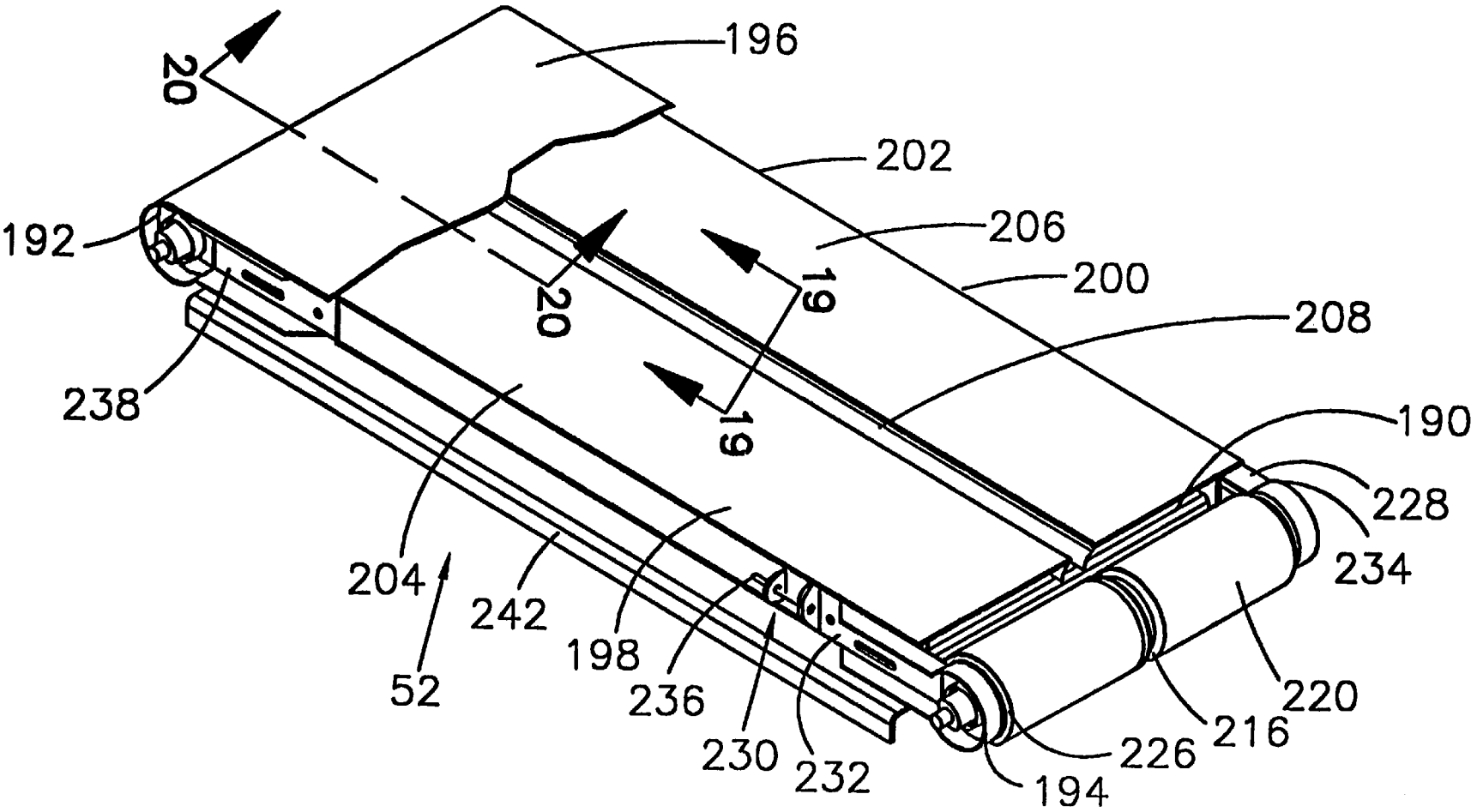
FIG. 17 is a top perspective view of a conveyor assembly with most of the endless conveyor belt removed in accordance with the present invention.
Figure 18:
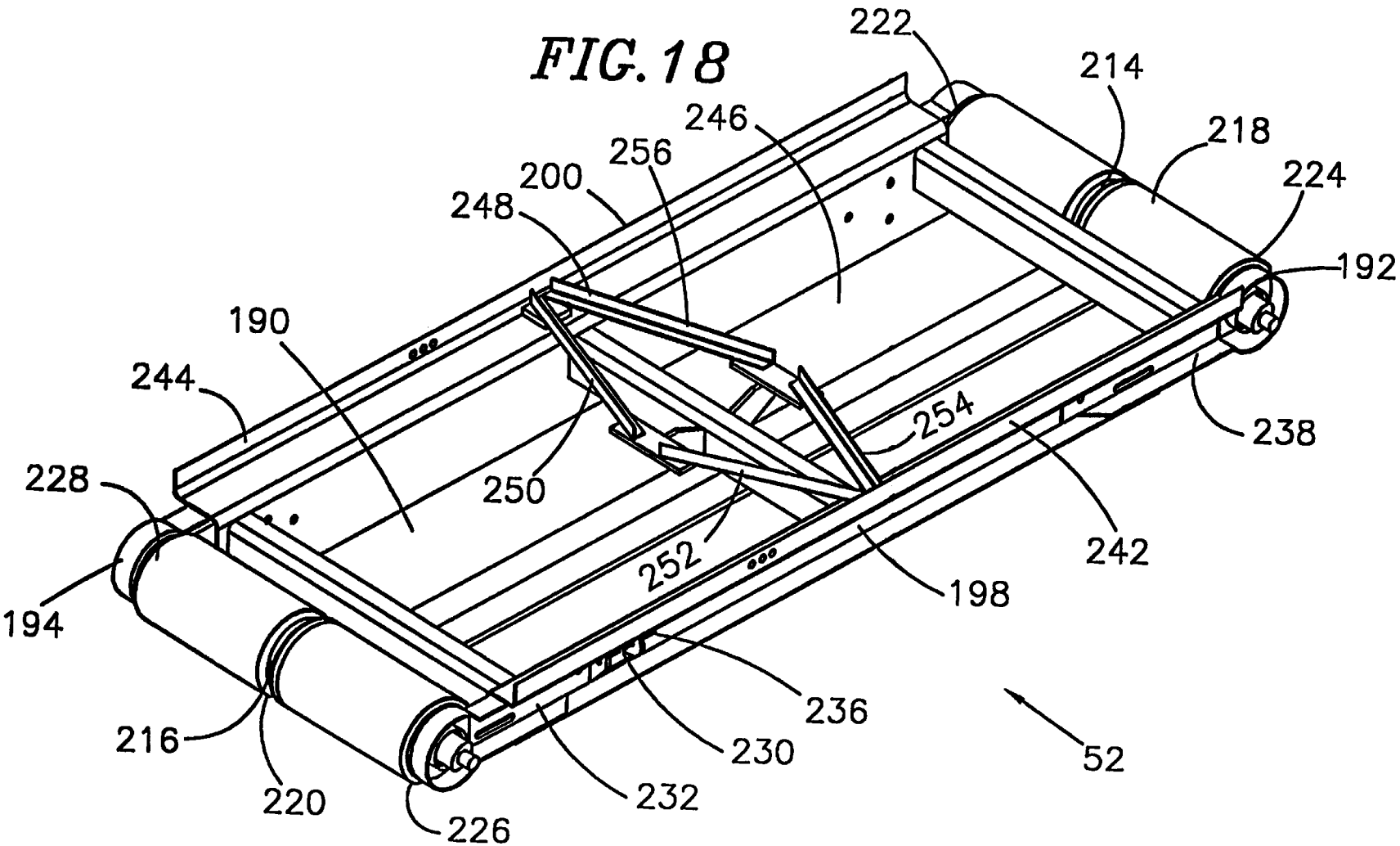
FIG. 18 is a bottom perspective view of the conveyor assembly shown in FIG. 17.
Figure 19:
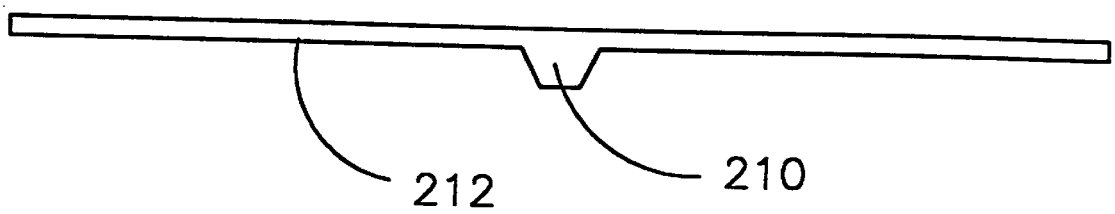
FIG. 19 is a cross-sectional view of the endless conveyor belt shown in FIG. 17 taken along lines 19—19.
Figure 20:
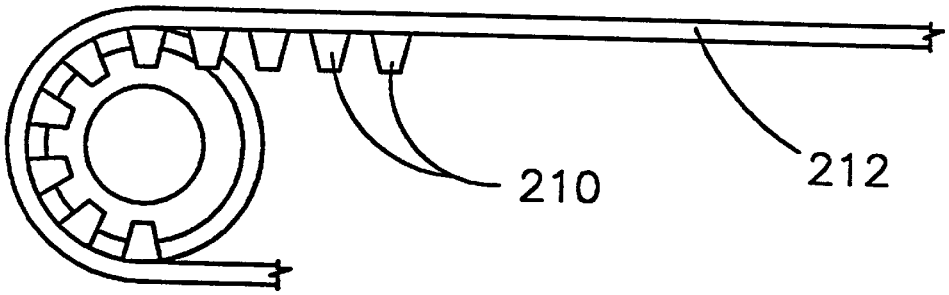
FIG. 20 is a cross-sectional view of the endless conveyor belt shown in FIG. 17 taken along lines 20—20.
Figure 21:
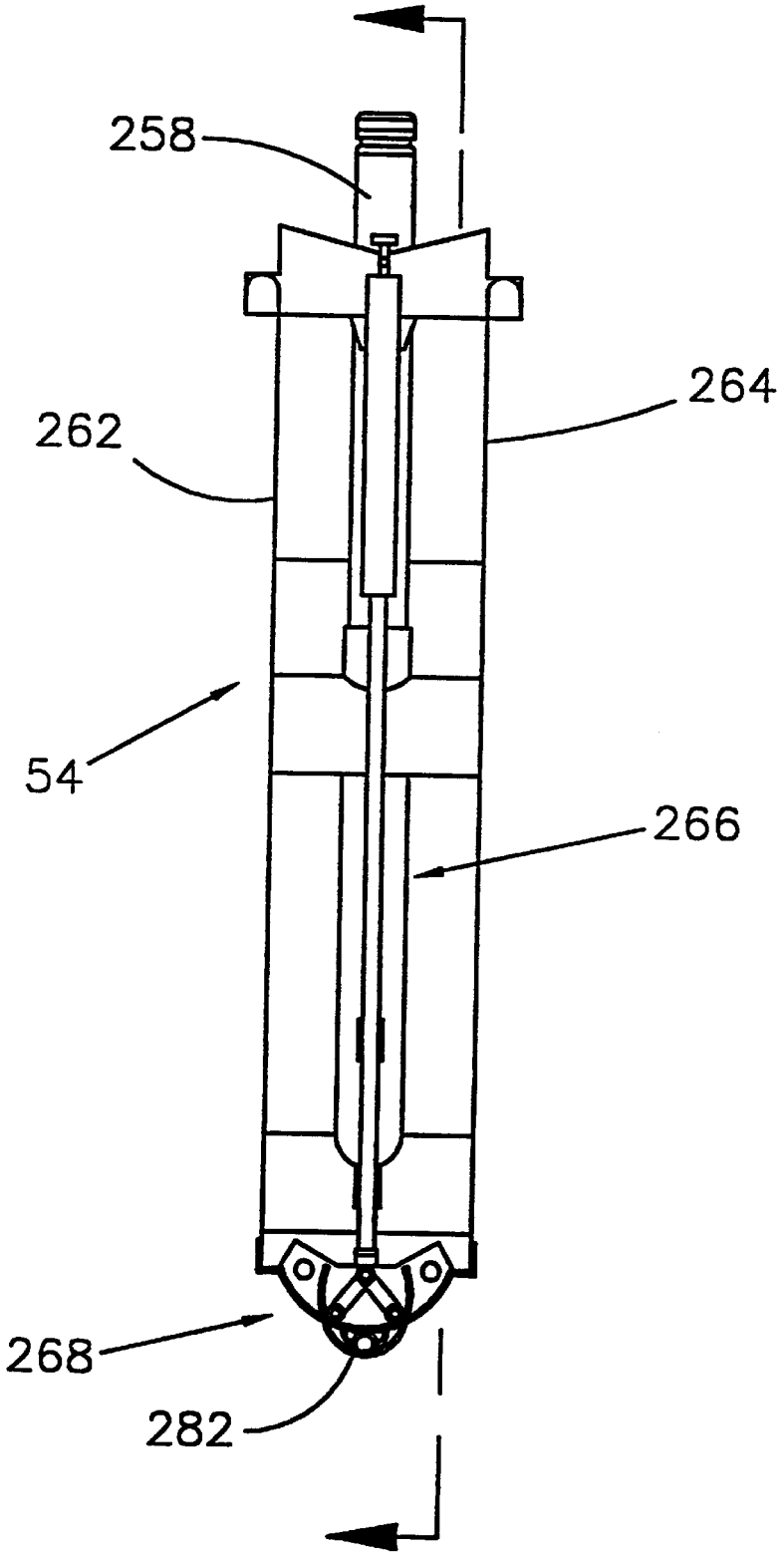
FIG. 21 is a side elevational view of a shoe assembly and an adjustable groover assembly in accordance with the present invention.
Figure 22:
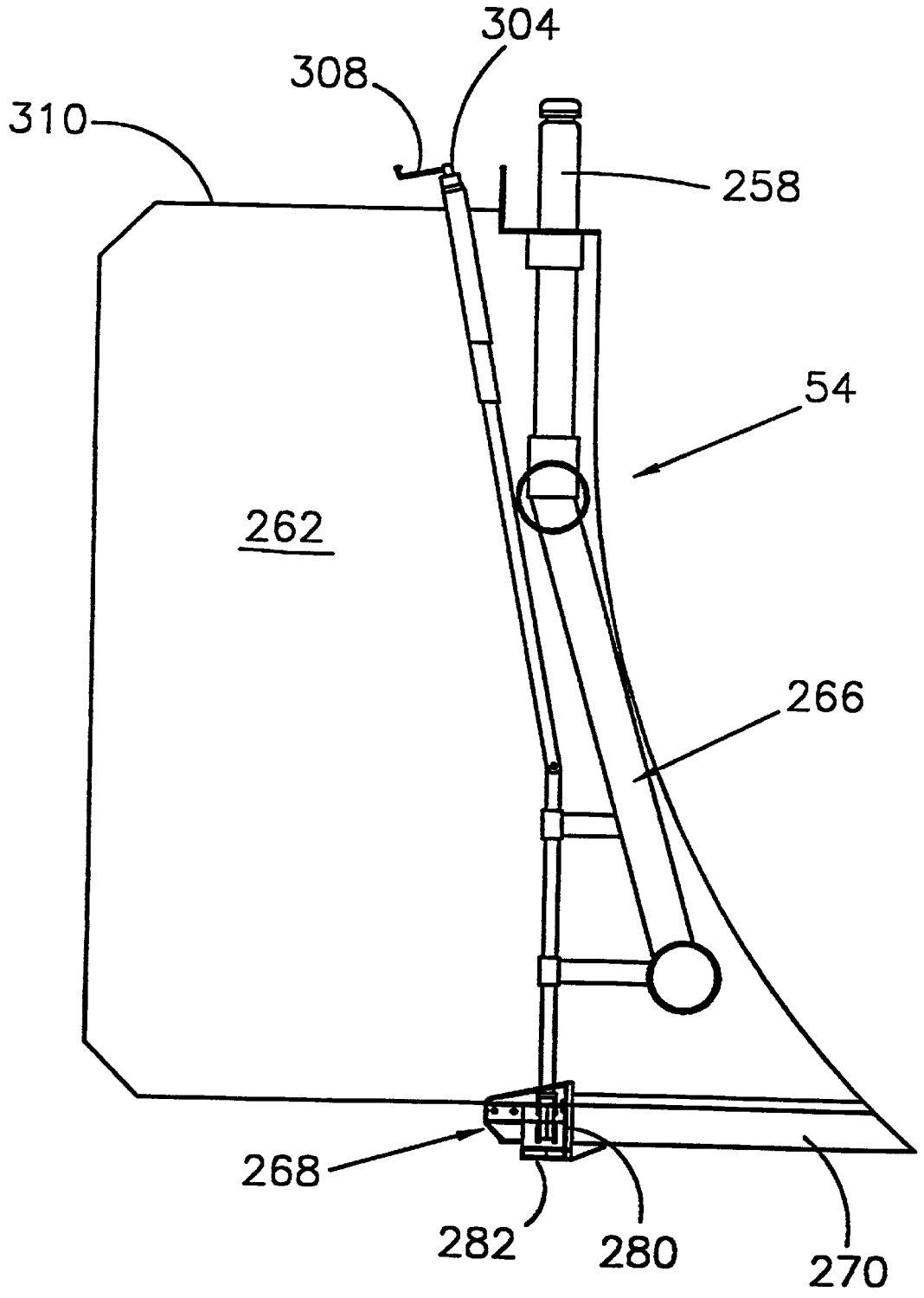
FIG. 22 is a sectional front elevational view of the shoe assembly and the adjustable groover assembly shown in FIG. 21 taken along lines 22—22.
Figure 23:
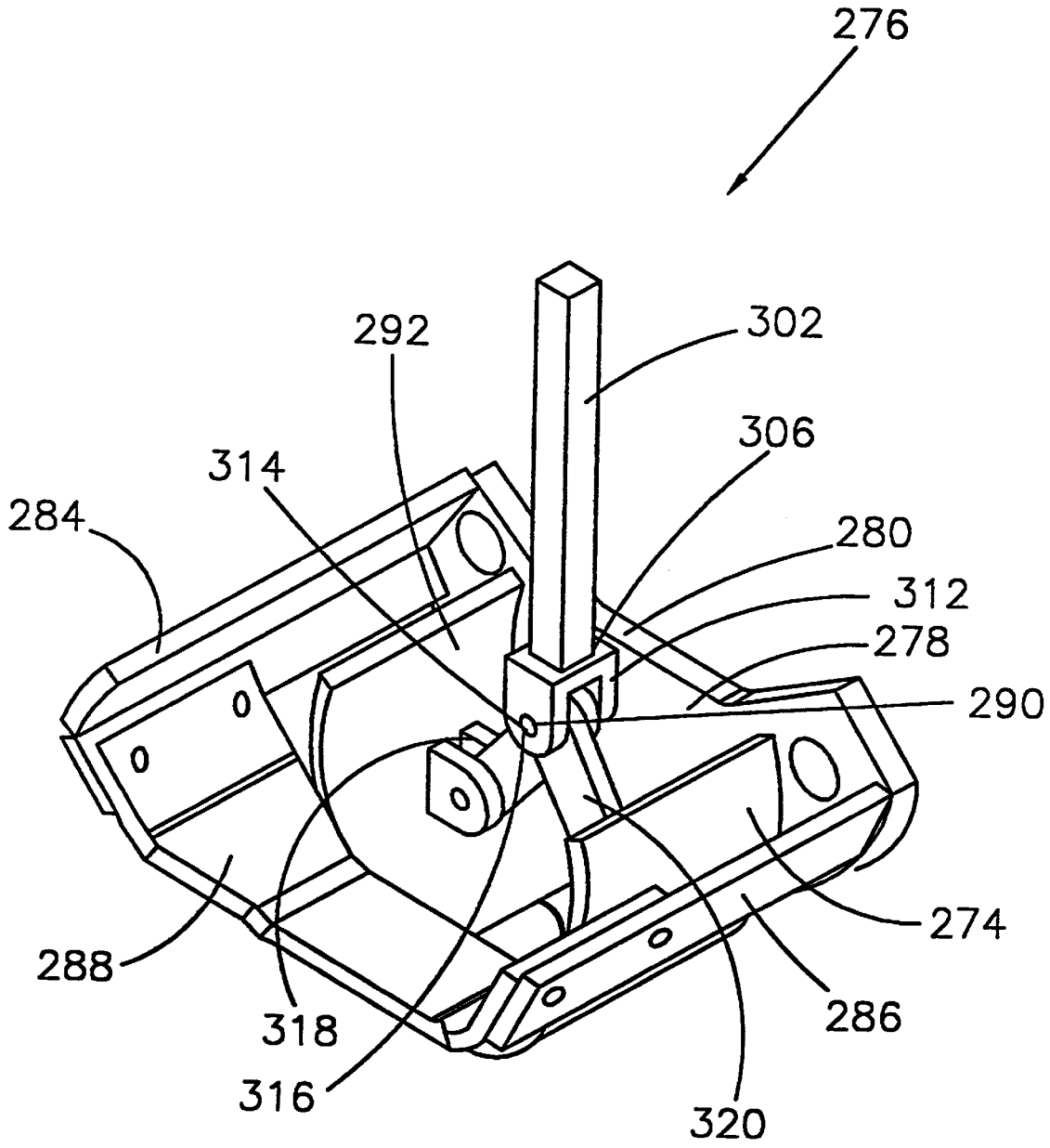
FIG. 23 is a top perspective view taken from the rear of the adjustable groover assembly and a mounting assembly shown in FIG. 21.
Figure 24:
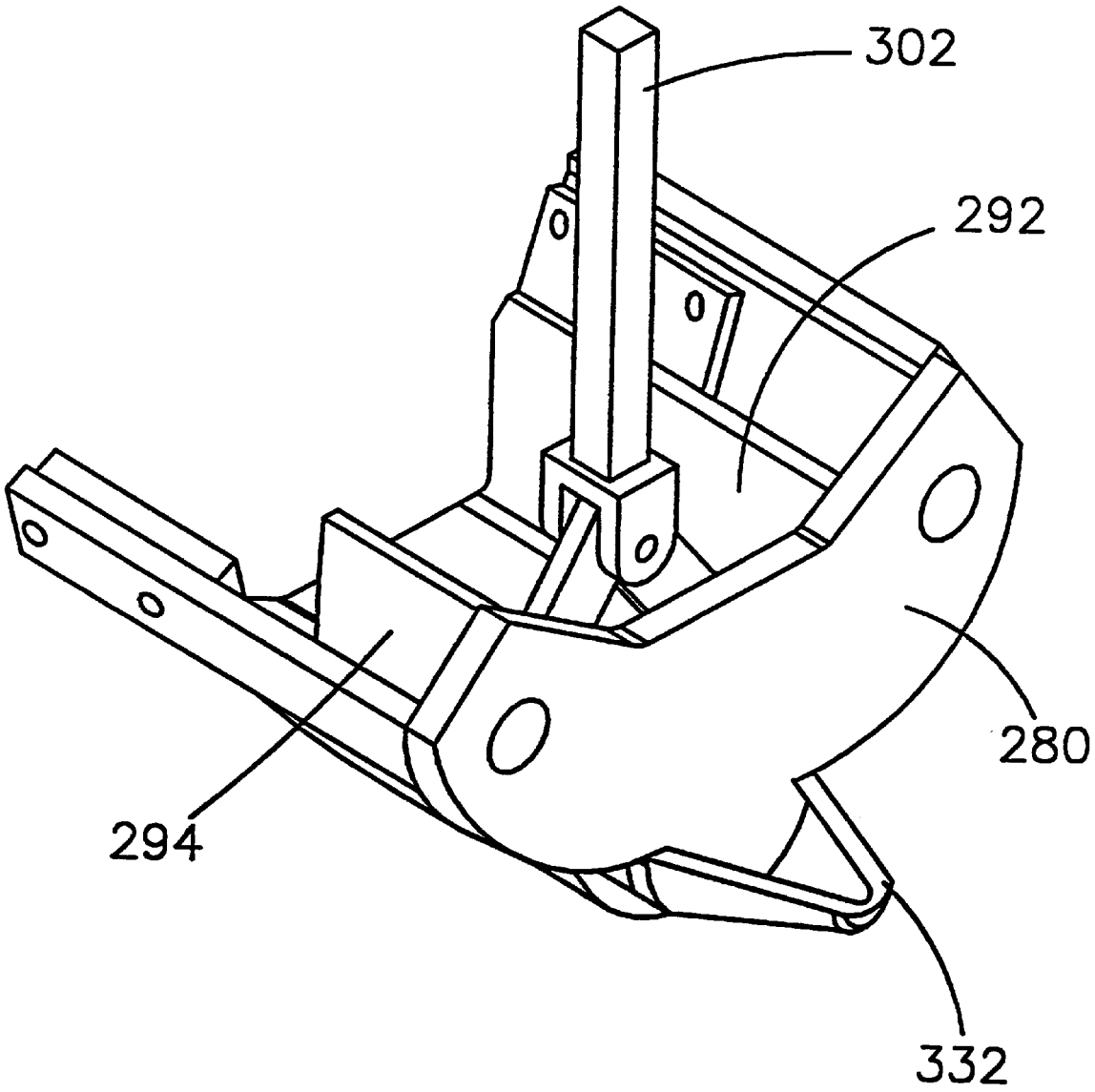
FIG. 24 is a top perspective view taken from the front of the adjustable groover assembly and the mounting assembly shown in FIG. 21.
Figure 25:
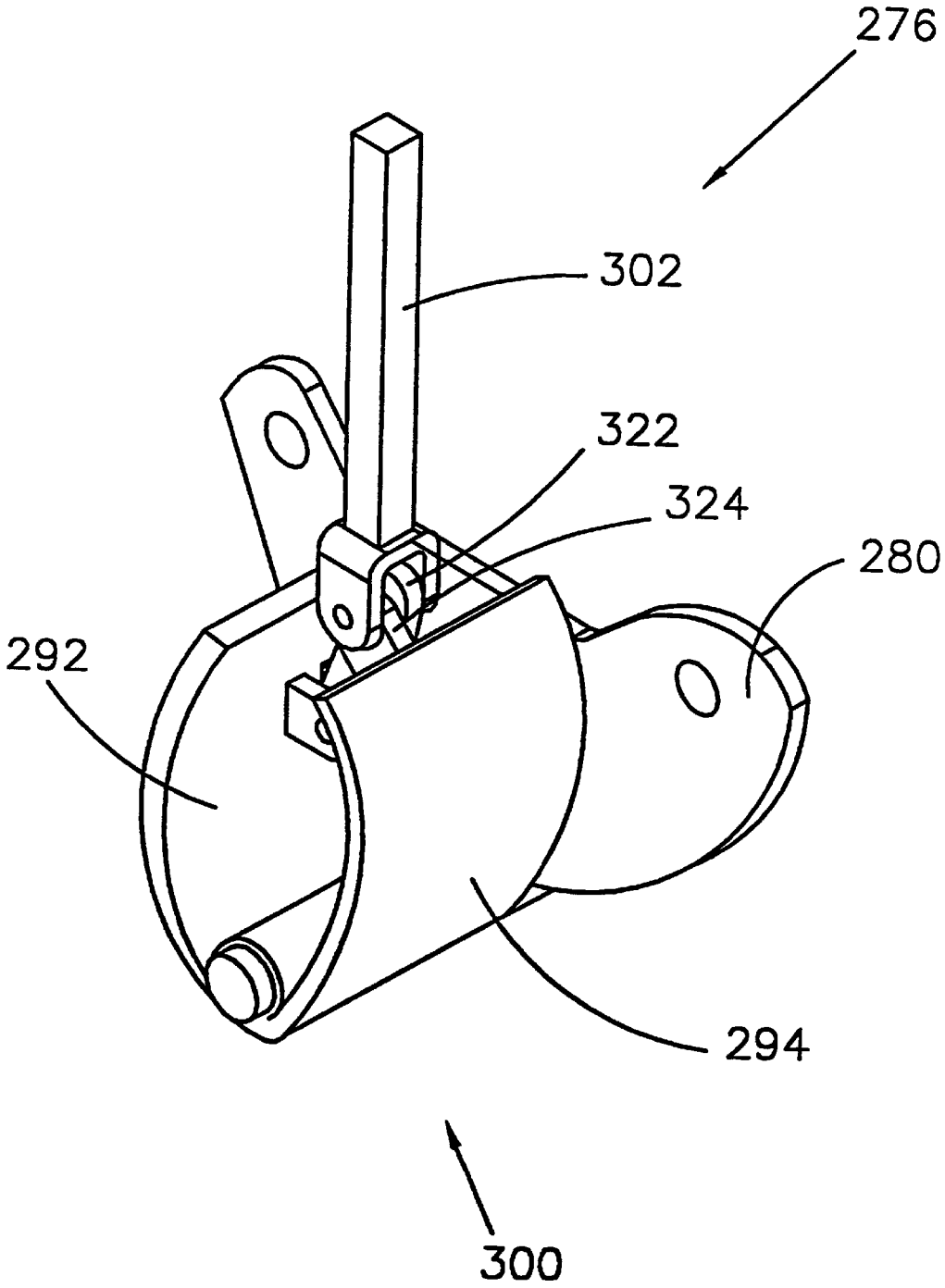
FIG. 25 is a top perspective view taken from the rear of the adjustable groover assembly shown in FIG. 21 in its closed position.
Figure 26:
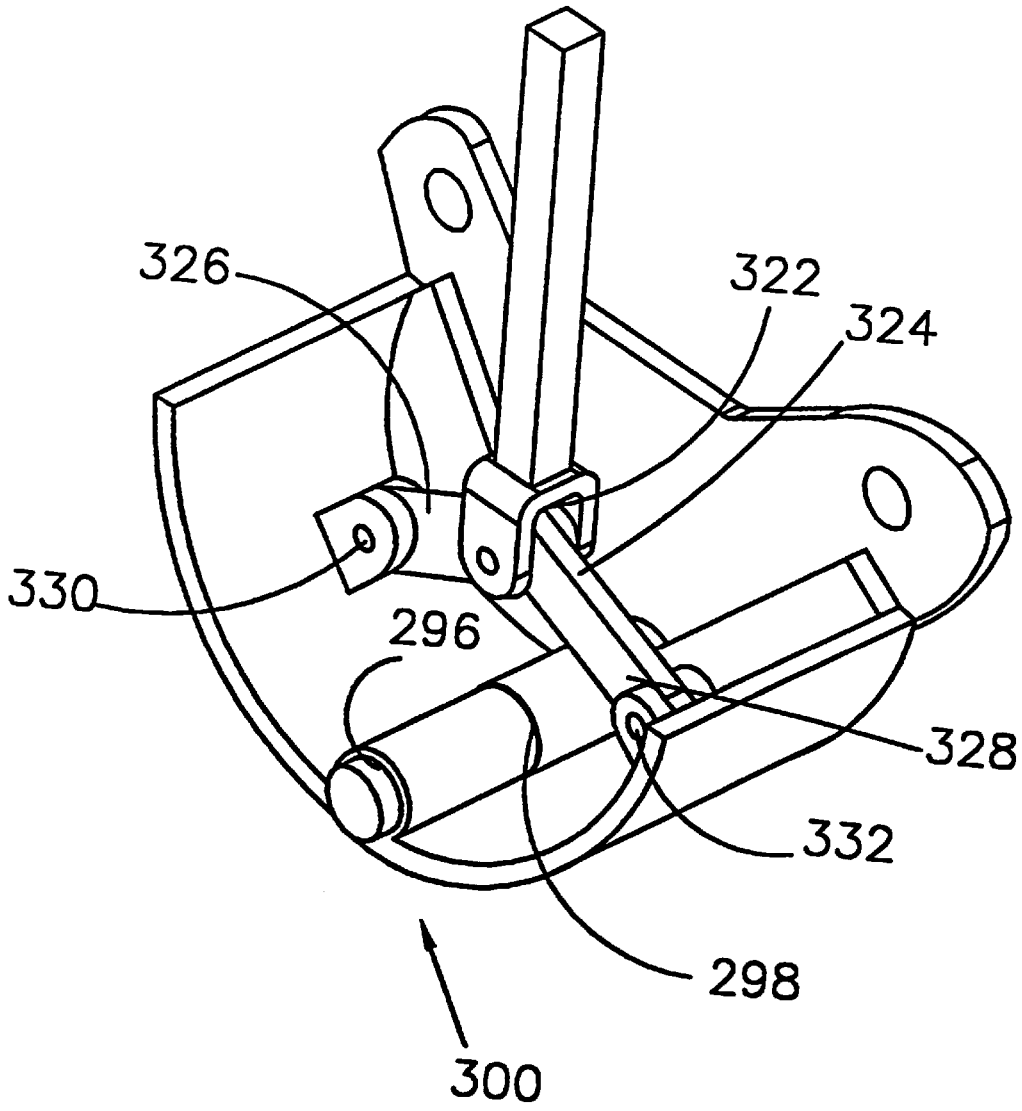
FIG. 26 is a top perspective view taken from the rear of the adjustable groover assembly shown in FIG. 21 in its open position.

An alternative embodiment of the cleaning member 144 is shown in FIG. 16. In this embodiment, a cleaning face 170 is attached directly to a mounting arm 172 which is pivotally mounted to a wheel frame assembly 174 about a horizontal axis 176. A coiled spring 178 is rigidly connected between the mounting arm 172 at 180 and the wheel frame assembly 174 at 182 to provide alternative biasing and retraction means. However, the cleaning face 184 and the ultimate position of the cleaning face 184 within the interior profile 148 of the rim structure 130 and the bucket member 132 would be identical.

Again, while the cleaning member 144 of the present invention is shown on an excavating machine 30 having a bucket wheel trencher assembly 42, it is to be understood that this cleaning member 144 could be sold separately as a retrofit part for existing equipment.

The conveyor assembly of the present invention is shown in FIGS. 17–20. The conveyor assembly 52 is operably attached to the wheel frame assembly 44 in a suspended manner at 186 and 188. This allows the conveyor assembly to be tilted from one side to another depending upon from which side the spoil 140 is to be expelled. The conveyor assembly 52 comprises an interior portion 190 bounded by a first end roller 192 and a second end roller 194 opposite to the first end roller 192, an endless conveyor belt 196 about the first end roller 192 and the second end roller 194, a first side assembly 198 and a second side assembly 200 opposite to the first side assembly 198, all to prevent the spoil 140 from entering the interior portion 190 of the conveyor assembly 52.

The conveyor assembly 52 further comprises a top plate 202 on which the endless conveyor belt 196 slides. In the preferred embodiment, this top plate 202 is made of an ultra-high molecular weight plastic to provide a minimal amount of friction between the endless conveyor belt 196 and the top plate 202. However, it is anticipated that other materials could be used. While the top plate 202 is shown in the preferred embodiment as separate plates 204 and 206 which are located side-by-side with a longitudinal channel 208 therebetween, it is to be understood that a single top plate could also be used having a longitudinal groove therein (not shown). The top plates 204 and 206 of the conveyor assembly 52 extend laterally beyond the first side assembly 198 and the second side assembly 200, respectively, in a manner so as to overlap the side assemblies 198 and 200 to prevent spoil 140 from entering the interior portion 190 of the conveyor assembly 52.

In the preferred embodiment, the endless conveyor belt 196 includes a series of finger-like projections 210 (FIGS. 19 and 20) along its underside 212 corresponding in alignment with the longitudinal channel 208 between the first top plate 204 and the second top plate 206 of the conveyor assembly 52 in order to act in combination as a guide for centering the endless conveyor belt 196 on the conveyor assembly 52. In addition, the first end roller 192 and the second end roller 194 each include an annular groove 214 and 216, respectively, in alignment with the longitudinal channel 208 between the first top plate 204 and the second top plate 206 of the conveyor assembly 52 in order to receive the finger-like projections 210 on the underside 212 of the endless conveyor belt 196 again to center the endless conveyor belt 196 on the conveyor assembly 52. The centering of the endless conveyor belt 196 on the conveyor assembly 52 is also assisted by a tapering of the first end roller 192 and the second end roller 194 wherein the center portion 218 and 220 of the first end roller and second end roller, respectively, is larger in diameter than the end portions 222 and 224 and 226 and 228 of the first end roller 192 and the second end roller 194, respectively.

A belt tension adjuster 230 allows an end member 232 of the first side assembly 198 and an end member 234 of the second side assembly 200, respectively, to be extended or retracted as necessary. The tension adjuster 230 comprises a thumb screw 231 which, upon turning, either extends or retracts the end members 232 and 234 of the first side assembly 198 and the second side assembly 200, respectively, along with the second end roller 194. The first end roller 192 is rigidly connected along with end members 238 and 240 of the first side assembly 198 and the second side assembly 200, respectively.

The first side assembly 198 and the second side assembly 200 further includes downwardly extended flanges 242 and 244, respectively, for preventing the spoil 140 from entering the interior portion 190 on the underside 246 of the conveyor assembly 52. For the minimal amount of spoil 140 that does enter the interior portion 190 of the conveyor assembly 52, a plow assembly is operably attached therein to direct the spoil 140 back out from the interior portion 190 of the conveyor assembly 52. The plow assembly is a diamond-shaped configuration of stop plates 250, 252, 254 and 256 which are angled towards the first side assembly 198 and the second side assembly 200. Accordingly, as spoil riding on the underside 212 of the endless conveyor belt 196 comes into contact with the stop plates 250–256 it is directed out of the conveyor assembly 52.

Once again, while the conveyor assembly 52 of the present invention is shown on an excavating machine 30 having a bucket wheel trencher assembly 42, the conveyor assembly 52 could be incorporated with any type of excavating machine having earth cutting means either as original equipment or sold separately as a retrofit part for existing equipment.

The shoe assembly 54 of the present invention is shown in FIGS. 21–26. The shoe assembly 54 includes a post member 258 for operable attachment at 260 with the supporting frame assembly 44. The shoe assembly further includes side plates 262 and 264 for contact with the side walls of the trench 56 in order to prevent a cave-in of the side walls of the trench 56 during use. The side plates 262 and 264 are supported and maintained in a spaced relationship by a tubular support assembly 266 which extends downwardly from the post member 258.

Grooving means 268 are operably attached along the bottom edge 270 of the shoe assembly 54 and extend therebelow to form a groove 272 in the bottom 274 of the trench 56. In the preferred embodiment, the grooving means 268 comprise adjustable groove means 276 for adjusting the radial dimension of the groove 272. The adjustable groove means 276 includes a mounting assembly 278 including a mounting plate 280 rigidly connected to a bottom member 282 of the shoe assembly 54. The mounting assembly 278 of the adjustable groove means 276 also includes side mounting plates 284 and 286 rigidly connected to sidewalls 262 and 264, respectively, of the shoe assembly 54 and a rear mounting plate 288 operably attached between the side mounting plates 284 and 286.

Suspended within the mounting assembly 278 and pivotally connected about a pivot member 290 extended rearwardly from the front mounting plate 280 is the adjustable groover assembly 291 of the adjustable groove means 276. The adjustable groover assembly 291 comprises a first arcuate groove plate 292 and a second arcuate groove plate 294 having apertures 296 and 298, respectively, for receiving the pivot member 290 extended rearwardly from the front mounting plate 280, the first arcuate groove plate 292 and the second arcuate groove plate 294 in combination resulting in an arc 300 of varying radius for forming the groove 272 in the bottom 274 of the trench 56.

Means for pivoting the first arcuate groove plate 292 relative to the second arcuate groove plate 294 are included comprising a linear actuator 302 having a first end 304 and a second end 306 opposite to the first end 304.

The first end 304 of the linear actuator 32 is operably attached to a hand-crank assembly 308 which is operably attached at the top edge 310 of the shoe assembly 54. The second end 306 of the linear actuator 302 is operably attached to a yoke member 312 having an aperture 314 for receiving a pivot member 316 therein. First and second link members 318 and 320 each having a first end 322 and 324, respectively, and a second end 326 and 328, respectively, are pivotally attached at their first ends 322, 324 to the yoke member 312 and at their second ends 324, 326 to the first arcuate groove plate 292 and the second arcuate groove plate 294, respectively, at pivot points 328 and 330, respectively.

Accordingly, as the linear actuator 302 is extended, the link members 318 and 320 extend the first arcuate groove plate 292 and the second arcuate groove plate 294 apart to form a groove of a larger radius. Likewise, when the linear actuator 302 is retracted, the link members 318 and 320 retract the first arcuate groove plate 292 relative to the second arcuate groove plate 294 to create a groove of a smaller radius.

A nose cone member 332 extends in front of the front mounting plate 280 in the direction of travel of the excavating machine 30 to penetrate the ground 58 to make way for the adjustable groover assembly 291.

And again, while the adjustable groover assembly 276 of the present invention is shown on an excavating machine 30 having a bucket wheel trencher assembly 42, it is to be understood that the adjustable groover assembly 276 could be incorporated with any type of excavating machine having earth cutting means as original equipment or sold separately as a retrofit part for existing equipment.

The foregoing description and drawings merely explain and illustrate the invention, and the invention is not limited thereto, except insofar as the claims are so limited as those skilled in the art who have the disclosure before them will be able to make modifications and variations therein without departing from the scope of the invention.

What is claimed is:

1. An excavating machine comprising:

(A) a power unit;

(B) earth cutting means comprising a continuous excavator pulled from behind said power unit;

(C) an L-arm assembly located between said power unit and said earth cutting means, said L-arm assembly having a first arm for operable attachment to said power unit, said first arm having a first end and a second end opposite to said first end, said L-arm assembly further having a second arm integral with and substantially transverse to said first arm for operable attachment to said earth cutting means, said second arm having a first end integral with said first end of said first arm and a second end opposite to said first end of said second arm, said first arm of said L-arm assembly being longer than said second arm of said L-arm, assembly;

(D) means for raising and lowering said L-arm assembly; and (E) means for adjusting the pitch of said earth cutting means relative to said L-arm assembly, wherein said means for adjusting the pitch is pivotally connected to said second arm substantially near said first end and said second end.

2. The excavating machine of claim 1, wherein said first arm comprises an integral frame having a top plate and first and second side plates extending transversely from said top plate, said first side plate being substantially parallel with said second side plate, said first arm of said L-arm assembly further having attachment means at said second end thereof for pivotal attachment to said power unit.

3. The excavating machine of claim 1, wherein said second arm of said L-arm assembly comprises a rectangular housing with attachment means extended from said second end thereof for pivotal attachment with said earth cutting means.

4. The excavating machine of claim 1, wherein said L-arm assembly further comprises means for attachment to said means for raising and lowering said L-arm assembly.

5. The excavating machine of claim 1, wherein said L-arm assembly further comprises means for attachment to said means for raising and lowering said L-arm assembly, said means for attachment being located proximate to said first end of said first arm of said L-arm assembly.

6. The excavating machine of claim 1, wherein said means for raising and lowering said L-arm assembly comprises a linear actuator operably attached between said power unit and said L-arm assembly.

7. The excavating machine of claim 1, wherein said means for adjusting the pitch of said earth cutting means comprises a linear actuator operably attached between said L-arm assembly and said earth cutting means.

8. The excavating machine according to claim 7, wherein said linear actuator operably attached between said L-arm assembly and said earth cutting means is extendable to create a downward force on said rotary trenching wheel.

9. The excavating machine of claim 8, wherein one of said parallel second arm members includes within its rectangular housing means for extending and retracting said extended attachment means relative to the attachment means of the other of said parallel second arm members.

10. The excavating machine of claim 9, wherein said means for extending and retracting said extended attachment means comprises a telescoping housing operably attached between a linear actuator and said extended attachment means.

11. The excavating machine of claim 1, wherein said L-arm assembly further comprises a pair of parallel L-arms, each of said L-arms having a first arm and a second arm integral with and substantially transverse to said first arm, said parallel L-arms having tubular support members extended transversely therebetween.

12. The excavating machine according to claim 1, wherein said means for raising and lowering said L-arm assembly comprises a linear actuator in operable connection between said power unit and said first arm.

13. An L-arm assembly for use on an excavating machine, said L-arm assembly for location between a power unit and an earth cutting means comprising a continuous excavator pulled from behind said power unit on said excavating machine, said L-arm assembly having a first arm for operable attachment to said power unit, said first arm having a first end and a second end opposite to said first end, said L-arm assembly further having a second arm integral with and substantially transverse to said first arm for operable attachment to said earth cutting means, said second arm having a first end integral with said first end of said first arm and a second end opposite to said first end of said second arm, said first arm of said L-arm assembly being longer than said second arm of said L-arm assembly, said L-arm assembly further comprising means for adjusting the pitch of said earth cutting means relative to said second arm, wherein said means for adjusting the pitch is pivotally connected to said second arm substantially near said first end and said second end.

14. The L-arm assembly of claim 13, wherein said first arm comprises an integral frame having a top plate and first and second side plates extending transversely from said top plate, said first side plate being parallel with said second side plate, said first arm of said L-arm assembly further having attachment means at said second end thereof for pivotal attachment to said power unit.

15. The L-Arm Assembly of claim 13, wherein said second arm of said L-arm assembly comprises a rectangular housing with attachment means extended from said second end thereof for pivotal attachment with said earth cutting means.

16. The L-Arm Assembly of claim 13, wherein said L-arm assembly further comprises a pair of parallel L-arms, each of said L-arms having a first arm and a second arm integral with and substantially transverse to said first arm, said parallel L-arms having tubular support members extended transversely therebetween.

17. The L-Arm Assembly of claim 15, wherein one of said parallel second arm members includes within its rectangular housing means for extending and retracting said extended attachment means relative to the attachment means of the other of said parallel second arm members.

18. The excavating machine of claim 17, wherein said means for extending and retracting said extended attachment means comprises a telescoping housing operably attached between a linear actuator and said extended attachment means.

19. An excavating machine comprising:

(A) a power unit;

(B) earth cutting means;

(C) an L-arm assembly located between said power unit and said earth cutting means, said L-arm assembly comprising a pair of parallel L-arms having a first arm for operable attachment to said power unit and a second arm integral with and substantially transverse to said first arm for operable attachment to said earth cutting means, each of said first arms having a first end and a second end opposite to said first end, each of said second arms having a first end integral with a corresponding one of said first ends of said first arms and a second end opposite to said first end of said second arm, each of said first arms being longer than said second arms, each of said second arms of said parallel L-arms comprising a rectangular housing with attachment means extended from said second end thereof for pivotal attachment with said earth cutting means, one of said parallel second arm members including within its rectangular housing means for extending and retracting said extended attachment means relative to the attachment means of the other of said parallel second arm members;

(D) means for raising and lowering said L-arm assembly;

(E) means for controlling the pitch of said earth cutting means relative to said L-arm assembly.

20. The excavating machine according to claim 19, wherein said means for extending and retracting said extended attachment means comprises a telescoping housing operably attached between a linear actuator and said extended attachment means.

21. An L-arm assembly for use on an excavating machine, said L-arm assembly for location between a power unit and earth cutting means on said excavating machine, said L-arm assembly comprising a pair of parallel L-arms, each of said L-arms having a first arm for operable attachment to said power unit, said first arms having a first end and a second end opposite to said first end, each of said L-arms further having a second arm integral with and substantially transverse to a corresponding one of said first arms for operable attachment to said earth cutting means, said second arms having a first end integral with said first end of said corresponding first arm and a second end opposite to said first end of said second arm, said first arms of said L-arm assembly being longer than said second arms of said L-arm assembly, said second arms of said L-arm assembly comprising a rectangular housing with attachment means extended from said second end thereof for pivotal attachment with said earth cutting means, said L-arm assembly further comprising means for extending and retracting said extended attachment means relative to the attachment means of the other of said parallel second arm members.

22.The L-arm assembly according to claim 21, wherein said means for extending and retracting said extended attachment means comprises a telescoping housing operably attached between a linear actuator and said extended attachment means.

* * * * *